US006587649B1

(12) United States Patent
Yamamoto et al.

(10) Patent No.: US 6,587,649 B1
(45) Date of Patent: Jul. 1, 2003

(54) IMAGE FORMING APPARATUS, CARTRIDGE DETACHABLY MOUNTABLE TO THE IMAGE FORMING APPARATUS, DEVELOPER REMAINDER DISPLAYING METHOD AND SYSTEM

(75) Inventors: Shinya Yamamoto, Numazu (JP); Hiroaki Ogata, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/689,858

(22) Filed: Oct. 13, 2000

(30) Foreign Application Priority Data

Oct. 15, 1999 (JP) ..... 11-294573

(51) Int. Cl.[7] ..... G03G 15/08
(52) U.S. Cl. ..... 399/27; 399/29; 399/30
(58) Field of Search ..... 399/24, 25, 27, 399/29, 30, 111, 119

(56) References Cited

U.S. PATENT DOCUMENTS

| | | | | |
|---|---|---|---|---|
| 4,961,088 A | * | 10/1990 | Gilliland et al. | 399/25 |
| 5,160,966 A | * | 11/1992 | Shiina et al. | 399/27 |
| 5,283,613 A | | 2/1994 | Midgley | 399/9 |
| 5,475,471 A | | 12/1995 | Kisu et al. | 399/115 |
| 5,534,344 A | | 7/1996 | Kisu et al. | 428/323 |
| 5,546,167 A | | 8/1996 | Ogata et al. | 399/174 |
| 5,678,141 A | | 10/1997 | Asano et al. | 399/115 |
| 5,794,094 A | * | 8/1998 | Boockholdt et al. | 399/27 |
| 5,802,419 A | | 9/1998 | Sakurai et al. | 399/26 |
| 5,802,420 A | | 9/1998 | Garr et al. | 399/27 |
| 5,835,818 A | | 11/1998 | Hoshika et al. | 399/26 |
| 5,923,917 A | * | 7/1999 | Sakurai et al. | 399/27 |
| 5,943,525 A | * | 8/1999 | Endo et al. | 399/27 |

FOREIGN PATENT DOCUMENTS

| | | | |
|---|---|---|---|
| JP | 407234578 A | * | 9/1995 |
| KR | 1999-0074822 | | 10/1999 |

* cited by examiner

*Primary Examiner*—Hoan Tran
(74) *Attorney, Agent, or Firm*—Fitzpatrick, Cella, Harper & Scinto

(57) ABSTRACT

An image forming apparatus includes a developer container for containing a developer; a developer amount detector for detecting the amount of the developer contained in the developer container; a memory; and a calculator for calculating a display level of the remaining amount of the developer. At least the developer container and the memory are in a unit which is detachably mountable to a main assembly of the image forming apparatus. The memory stores information relating to a lifetime of the unit, and a device calculates the display level in accordance with the amount detected by the developer amount detector and the information relating to the lifetime of the unit.

35 Claims, 11 Drawing Sheets

IMAGE FORMING APPARATUS, CARTRIDGE DETACHABLY MOUNTABLE TO THE IMAGE FORMING APPARATUS, DEVELOPER REMAINDER DISPLAYING METHOD AND SYSTEM

BACKGROUND OF THE INVENTION

Field of the Invention

The present invention relates to an image forming apparatus such as a copying machine or a printer, a cartridge detachably mountable to such an image forming apparatus, a displaying method for displaying a developer remainder, and a developer remainder displaying system, more particularly to an image forming apparatus for correctly displaying the remaining amount of the developer, a cartridge detachably mountable to such an image forming apparatus, and a developer remainder displaying method and a developer remainder displaying system.

Here, examples of the electrophotographic image forming apparatus include an electrophotographic copying machine, an electrophotographic printer (a laser beam printer or an LED printer mountable), a facsimile machine, a word processor and the like.

The process cartridge integrally contains an electrophotographic photosensitive drum, and charging means, developing means or cartridge, in the form of a unit or a cartridge, which is detachably mountable to a main assembly of an image forming apparatus.

Heretofore, in an electrophotographic image forming apparatus using the electrophotographic image process, a process-cartridge type in which the electrophotographic photosensitive member and process means actable on the electrophotographic photosensitive member are integrally contained in a cartridge, is detachably mountable to the main assembly of the image forming apparatus. In such a process-cartridge type, the maintenance of the apparatus can be carried out by the users without a serviceman, and therefore, the operativity can be improved significantly, and for this reason, it is widely used in the image forming apparatus. Therefore, the process cartridge type is widely used in the field of the electrophotographic image forming apparatus.

With such an electrophotographic image forming apparatus of the process cartridge type, when the developer is used up, the cartridge is exchanged, and the images can be formed, but the exchange of the cartridge has to be carried out by the user, so that a developer amount detecting device is to be provided to notify the user of the shortage of the developer.

In order to provide information about the remaining amount of the developer, the cartridge or the main assembly of the image forming apparatus is provided with developer remainder detecting means for detecting the developer remainder.

An example of such developer remainder detecting means is an electrostatic capacity detecting-type means. An antenna for detection of the developer remainder is disposed in the developer accommodating container, and an AC voltage is applied to the electrode provided at a predetermined position, by which an electric current is produced in the antenna in accordance with the amount of the developer existing between the electrode and the antenna. The developer remainder is detected on the basis of the change of the current.

For example, a flat antenna type is known, which is an electrostatic capacity detecting type detecting member. As shown in FIG. 3, the flat antenna comprises a pair of electroconductive patterns 22, 23 on a substrate 21 with a predetermined clearance therebetween. It is disposed at a position for contact with the developer at an inner side surface of the developer accommodating container, for example. With the decrease of the developer in the developer accommodating container, the contact area between the developer and the flat antenna 20 decreases.

With the consumption of the developer, the contact area between the developer and the surface of the electroconductive pattern changes, so that the electrostatic capacity therebetween changes, and therefore, the developer remainder in the container and the electrostatic capacity of the flat antenna correspond to each other. By measuring the electrostatic capacity of the flat antenna, the developer remainder in the container can be known.

Another type of electrostatic capacity detecting type detector is used with a so-called jumping development system wherein an AC bias is applied to the developing roller, which is a developer carrying member disposed in the developer accommodating container, by which a latent image on the photosensitive member is developed. The detector is a plate antenna type comprising a plate (plate antenna) provided in parallel with the developing roller.

It uses the change of the electrostatic capacity between the plate antenna and the developing roller in accordance with the amount of the insulative developer present between them. When the space between the plate antenna and the developing roller is filled with the developer, the electrostatic capacity is large, and with the decrease of the developer, the air in the space increases so that electrostatic capacity decreases. Therefore, the amount of the developer can be detected by a relation between the electrostatic capacity between the plate antenna and the developing roller and the amount of the developer.

By providing the developer accommodating portion, that is, the developer accommodating container with the developer remainder detecting means, the developer remainder can be detected substantially in real time, and simultaneously, it can be known substantially in real time how many image formations can be performed.

Another detecting means for the developer remainder is a torque detecting type detecting means in which developer stirring means is provided in the developer accommodating container, and the developer remainder is detected using the change of the load of the developer stirring means in accordance with the developer remainder.

Recently, with the change in the office environment resulting from the wider use of the personal computers, the print volume, which is the number of uses of the image forming apparatus by the users and the number of prints per unit time, has tended to increase. With such a tendency, the frequency of the exchanges of the process cartridges increases, and the exchanging operations and the cost required therefor have become a problem.

As a countermeasure, a large capacity process cartridge has been developed that has a longer nominal lifetime because of the larger amount of the developer in the developer accommodating container despite the fact that configuration and the size are the same as the normal process cartridge, both of them being usable with the same image forming apparatus.

Here, the term "nominal lifetime" means the number of sheets on which images can be formed by one process cartridge on the assumption that the print ratio is standard for all images (5%).

The user can selectively use the normal process cartridge or the large capacity process cartridge in view of the situations, thus permitting the load and cost required by the exchange of the process cartridge to be reduced.

However, if the process cartridges having the different amounts of the developer in the developer accommodating containers are alternately used, the correct display of the developer remainders in the developer accommodating container of the process cartridge has not been accomplished.

When the remaining amount of the developer is displayed on a display of the printer or on a display of a personal computer, the displayed information is desirably easy to understand. It is desirable to display the remaining amount in the form of a bar graph, a circle graph or numerical graph, and it is particularly preferable to display it in a percentage.

Doing so involves the following problems.

For example, the case will be described in which the normal cartridge S having a nominal lifetime of 5000 sheets and the large capacity cartridge L having a nominal lifetime of 10000 sheets are available, the two types of the process cartridges are usable with the one and the same image forming apparatus. In such a case, in the cartridge S, the toner is filled only up to half of the full height of the flat antenna, as shown in FIG. 3, and in the cartridge L, the toner is filled up to the top end of the flat antenna.

It is desirable that the remaining amount display level of the cartridge S originally before the start of use is 100%, but the actual display level of the remaining amount is 50%. This is because the toner is only up to one half the flat antenna height. This will confuse the user, since the unused process cartridge is displayed as containing only one half the complete amount of developer.

Furthermore, in some cases, a cartridge, which may have a different nominal capacity than that of the cartridge first put on sale, may later be put on the market because of demands therefrom. In consideration of such a case, it is desirable to develop a developer remainder notifying function capable of covering the unknown future nominal lifetime of the process cartridge.

Therefore, it would be desirable to provide means capable of notifying the user in substantially real time of the correct developer remainder amount for each of the process cartridges having different nominal lifetimes.

By using such developer remainder detecting means, the developer remainder level in the developer accommodating container can be known in substantially real time by the user, and it is possible to notify the user of the fact that cartridge-exchange timing is approaching.

The user has to prepare a fresh process cartridge before the depletion of the developer (incapability of image formation). Therefore, the warning-generation timing is determined in view of the printable number before the cartridge becomes incapable of printing.

If the time period or the printable number before the cartridge becomes incapable of printing is different depending on the process cartridges, the time given to the preparation is not constant, thus causing a deterioration in usability.

It is therefore desired to provide the proper timing warning to the operator despite the use of process cartridges having different nominal lifetimes.

SUMMARY OF THE INVENTION

Accordingly, it is a principal object of the present invention to provide an image forming apparatus, a cartridge detachably mountable to the image forming apparatus, a remaining amount displaying method, a remaining amount displaying system and a remaining amount display method, wherein the developer remaining amount can be displayed in an easily understandable manner.

It is another object of the present invention to provide an image forming apparatus, a cartridge detachably mountable to the image forming apparatus, a remaining amount displaying method, a remaining amount displaying system and a remaining amount displaying method.

According to an aspect of the present invention, there is provided an image forming apparatus comprising a developer container for containing a developer; developer amount detecting means for detecting the amount of the developer contained in said developer container; a memory; calculating means for calculating a display level of a remaining amount of the developer, wherein at least the developer container and the memory are in a unit that is detachably mountable to a main assembly of the image forming apparatus, wherein the memory stores information relating to a lifetime of the unit, and wherein the calculating means calculates the display level in accordance with the amount detected by the developer amount detecting means and the information relating to the lifetime of the cartridge.

According to another aspect of the present invention, there is provided an image forming apparatus comprising a unit detachably mountable to a main assembly of an image forming apparatus, the unit having a memory and a developer container for containing a developer; calculating means for calculating a display level of a remaining amount of the developer; wherein the memory stores information relating to the lifetime of the unit, and the calculating means calculates the display level in accordance with the remaining amount of the developer in the developer container and the information relating to the lifetime of the cartridge.

According to a further aspect of the present invention, there is provided a process cartridge comprising a memory; and a developer container for containing a developer, wherein the memory stores information relating to the lifetime of the unit.

According to a further aspect of the present invention, there is provided a displaying method for displaying a developer remainder in a unit detachably mountable to an image forming apparatus, comprising a step of detecting a remaining amount of the developer in the unit; a step of calculating a developer remainder display level in accordance with a detected developer remaining amount and information identifying the unit; and a step of displaying the thus calculated display level on a display.

According to a further aspect of the present invention, there is provided a developer remainder displaying system comprising a first unit that is detachably mountable to a main assembly of an image forming apparatus, wherein a developer is filled in the first unit; a second unit that is detachably mountable to a main assembly of the image forming apparatus, wherein the amount of the developer which is larger than the amount of the developer filled in the first unit is filled in the first unit, and wherein the second unit can be mounted to the main assembly of the image forming apparatus in place of the first unit; a display for displaying the remaining amount of the developer; wherein the amount of change of the remaining amount display level on the display per unit consumption of the developer when the second unit is mounted, is smaller than that when the first unit is mounted.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to accompanying drawings, a description will be provided as to an image forming apparatus and a process cartridge detachably mountable to the image forming apparatus.

Embodiment 1

Figure 1:
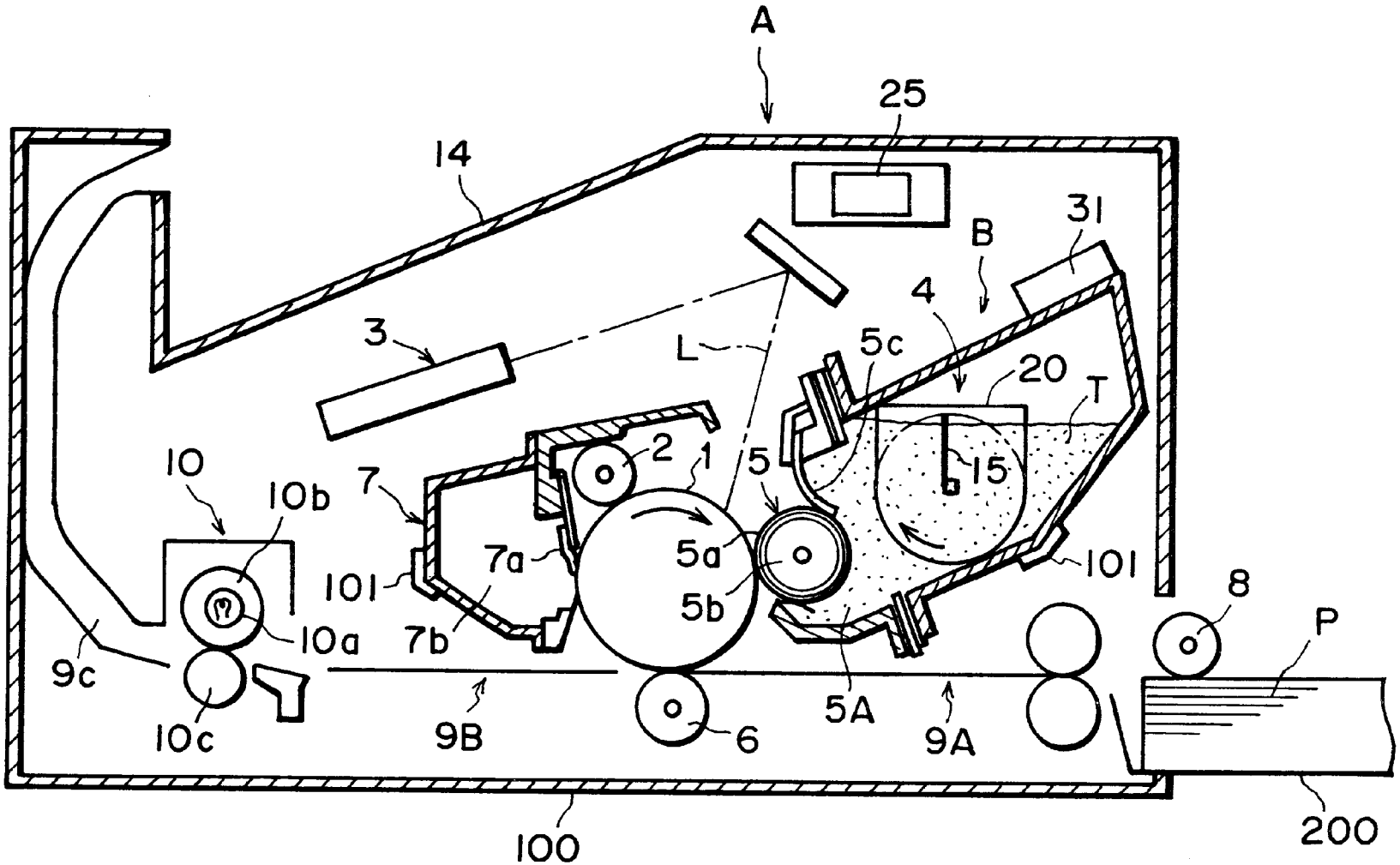
FIG. 1 is a sectional view of a process cartridge and an image forming apparatus according to an embodiment of the present invention.
Figure 2:
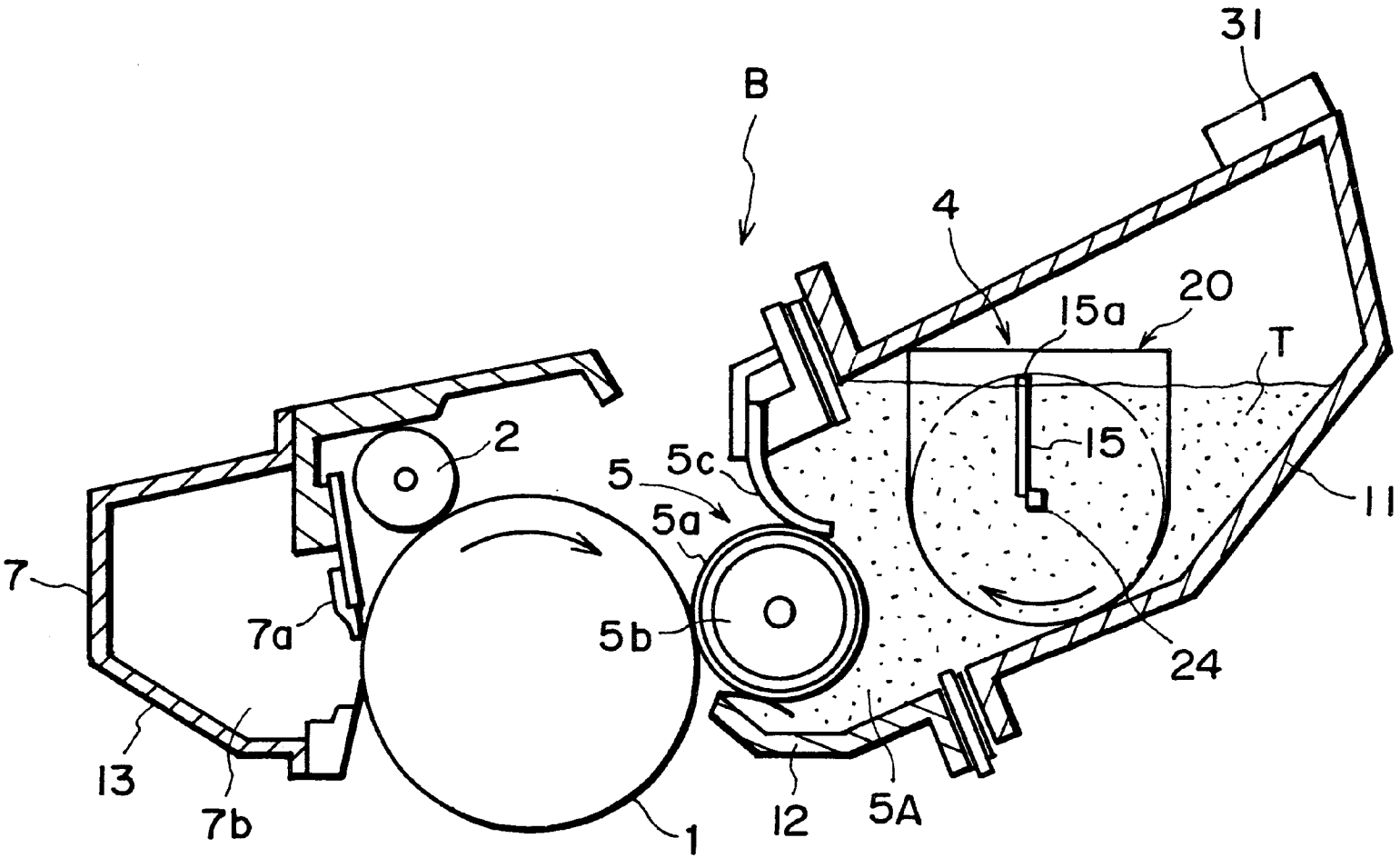
FIG. 2 is an enlarged sectional view of the process cartridge of FIG. 1.
Figure 3:
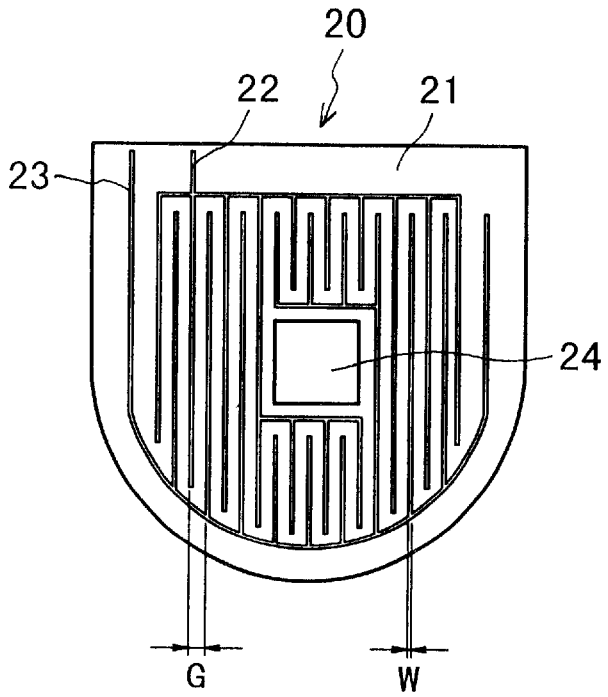
FIG. 3 is an illustration of a developer remainder detecting means which can be provided on the process cartridge according to an embodiment of the present invention.

Referring to FIGS. 1–3, an electrophotographic image forming apparatus to which a process cartridge is detachably mountable will be described. In this embodiment, the electrophotographic image forming apparatus is in the form of a laser beam printer A of an electrophotographic type, and images can be formed on a recording material, such as recording paper, an OHP sheet, textile or the like, through an electrophotographic image forming process.

The laser beam printer A comprises a drum-configuration electrophotographic photosensitive member, namely, a photosensitive drum 1. The photosensitive drum 1 is electrically charged by a charging means in the form of a charging roller 2, and then is exposed to a laser beam L, which has been modulated in accordance with image information and which comes from a laser scanner 3, so that a latent image is formed on the photosensitive drum 1 in accordance with the image information. The latent image is visualized by a developing means 5 into a visualized image, namely, a toner image.

The developing means 5 is provided with a developer carrying member in the form of a developing roller 5*a* and a developer chamber 5A, wherein a developer T in the developer accommodating portion in the form of a developer accommodating container 4 provided adjacent the developer chamber 5A is fed out to the developing roller 5*a* in the developer chamber 5A by the rotation of the developer feeding member 15. In this embodiment, the developer T is an insulative, one-component toner. The developing roller 5*a* contains therein a fixed magnet 5*b*, and by rotating the developing roller 5*a*, the developer is fed, and a triboelectric charge is applied to the toner by a developing blade 5*c* and is formed into a layer of the developer having a predetermined thickness. The layer of the developer is carried to a developing zone where the layer is opposed to the photosensitive drum 1. The developer supplied to the developing zone is transferred onto the latent image on the photosensitive drum to form the toner image. The developing roller 5*a* is connected with a developing bias circuit and is normally supplied with a developing bias voltage which is in the form of an AC biased DC voltage.

On the other hand, in synchronism with the formation of a toner image, the recording material P is fed from a sheet feeding cassette 200 to an image transfer position by a pick-up roller 8 and feeding means 9A. At the transfer position, there is provided a transferring means in the form of a transfer roller 6, to which a voltage is applied to transfer the toner image from the photosensitive drum 1 onto the recording material P.

The recording material P now having the transferred toner image is fed to a fixing means 10 by a feeding means 9B. The fixing means 10 comprises a fixing roller 10*b* containing a heater 10*a* and a driving roller 10*c*. It applies heat and pressure to the recording material P passing therethrough to fix the toner image on the recording material P.

The recording material P is discharged to the discharging tray 14 by feeding means 9C. The discharging tray 14 is provided on the topside of the main assembly 100 of the laser beam printer A apparatus.

The photosensitive drum 1, after the toner image is transferred onto the recording material P by the transfer roller 6, is cleaned by a cleaning means 7 so that developer remaining on the photosensitive drum 1 is removed, so as to be prepared for the next image forming process operation. The cleaning means 7 scrapes the residual developer off the photosensitive drum 7 by an elastic cleaning blade 7*a* press-contacted to the photosensitive drum 1 and collects and removes the developer in a developer stagnation 7*b*.

On the other hand, the process cartridge B in this embodiment comprises, as shown in FIG. 2, a developer frame 11 having a developer accommodating container 4 accommodating a developer and a developer feeding member 15, and a developing device frame 12 supporting the developing means 5 including the developing roller 5*a* and the developing blade 5*c*, which frames are welded together into a developing unit. The developing unit is coupled with a cleaning frame 13 having the photosensitive drum 1, the cleaning means 7 such as the cleaning blade 7*a* and the charging roller 2 to form a cartridge.

The process cartridge B is detachably mountable to a cartridge mounting means 101 provided in the main assembly 100 of the image forming apparatus by a user.

The image forming apparatus is usable with two types of process cartridges B, one of which has a nominal lifetime of 6000 sheets (process cartridge B1) and the other of which has a nominal lifetime of 10000 sheets (process cartridge B2). In this embodiment, the term "nominal lifetime" means the number of sheets on which images can be formed by one process cartridge on the assumption that print ratio is standard for all images (5%). These two types of process cartridges B1, B2 have the same shape, and are detachably mountable to the same image forming apparatus, and the only difference is in the amount of the developer filled in the developer accommodating portion 4.

The process cartridges B1, B2 are each provided with developer amount detecting device 30 (FIG. 6) which includes detecting means 20 for detecting the amount of the developer remainder which is capable of detecting substantially in real time the remaining amount of the developer T in the developer accommodating container 4 in response to the consumption thereof. The process cartridges B1, B2 are each provided with storing means for storing information relating to the lifetime of the process cartridge and storing means for storing a developer remainder level, which is valid even when the process cartridge is exchanged with another. In this embodiment, the same storing means 31 is used as the storing means, which will be described hereinafter.

Figure 6:
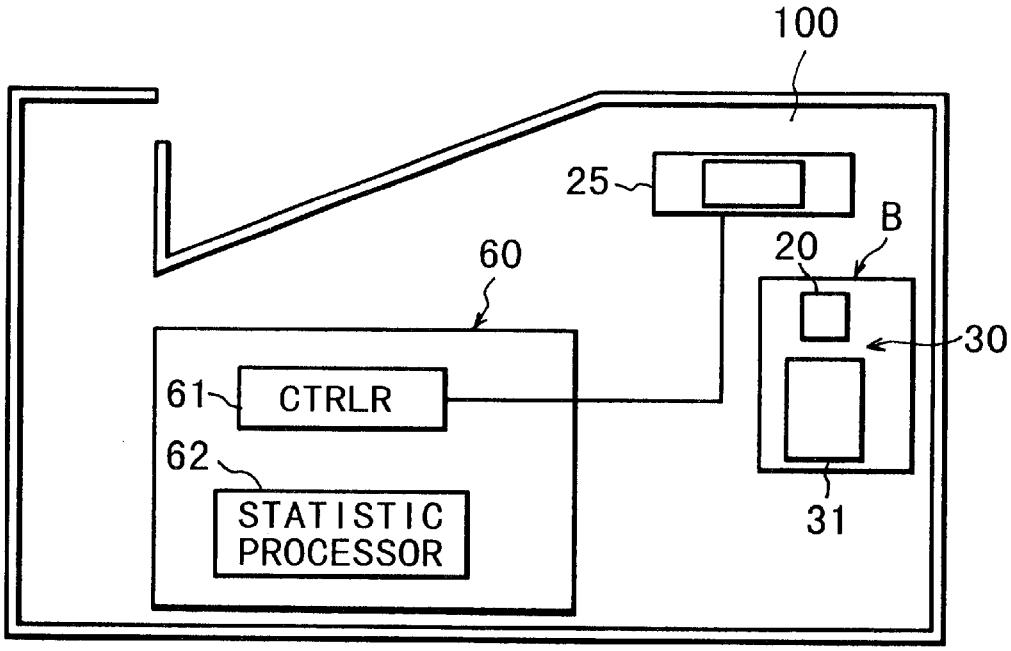
FIG. 6 is an illustration of the relationship among a processing means for calculating a developer remainder level, a storing means provided in the process cartridge, and a displaying means provided in the main assembly of an image forming apparatus.

As shown in FIG. 6, the image forming apparatus is provided with processing means 60, which calculates the level of the amount of the remainder of the developer from the result of detection of the developer remainder detecting means 20 and information relating to the nominal lifetime of the process cartridge stored in the storing means 31, and is provided with means 25 for displaying the calculated developer remainder level. In place of the displaying means 25 provided in the main assembly 100 of the image forming apparatus, a display of a personal computer, which is communicable with the image forming apparatus, may be provided to display the information. Simultaneously with the displaying, or independently therefrom, the information may be printed out on a recording material P, thus notifying the operator.

A description will be provided as to each of the means in conjunction with the accompanying drawings.

Developer remainder detecting means:

In this embodiment, the developer remainder detecting device 30 is of an electrostatic capacity detecting type device using a planar antenna (flat antenna) 20 provided on the process cartridge B.

More particularly, in this embodiment, the developer accommodating container 4 is provided therein with the stirring means 15, which rotates in the direction of the arrow in FIG. 1, and the stirring means 15 is effective to supply the developer T to the developing roller 5*a* while loosening the developer T, by the rotation thereof, as described in the foregoing. In addition, an inner side wall of the developer accommodating container 4 is provided with a planar antenna 20, which is the developer remainder detecting means, as shown in FIG. 3.

The planar antenna 20 comprises a printed board 21 and two electroconductor patterns (electrode) 22, 23 thereon provided by etching or printing. In order to protect the circuit diagram shape, a protecting film (unshown) is provided on the electroconductive patterns 22, 23. The electroconductive pattern is properly determined by one skilled in the art, and in this embodiment, the widths (W) of the two electroconductive patterns 22, 23 of the planar antenna 20 are 300 $\mu$m, and the clearance (G) between the two electroconductive patterns 22, 23 is as small as 300 $\mu$m approximately.

When an AC bias voltage of 200Vpp, 2000 Hz is applied between the electrodes 22, 23 of the electroconductive pattern, the electrostatic capacity was 20 pF when no developer contacted to the planar antenna 20, and was 60 pF when the developer contacts the whole surface of the planar antenna 20.

By repeating the image forming process, the developer T in the developer accommodating container 4 decreases, and with the decrease of the contact area between the planar antenna 20 and the developer T, the electrostatic capacity between the electroconductive patterns 22, 23 also decreases. By obtaining the electrostatic capacity, the amount of the developer T in the developer accommodating container 4 can be detected at any desired point of time.

Actually, however, the measurements involve variations due to that fact that even if the developer T in the developer accommodating container 4 is gradually reduced, a small amount of the developer remains on the planar antenna 20.

In order to solve this problem, an antenna cleaning member 15*a* is provided an end of the stirring means 15 to remove the developer deposited on the surface thereof, so that the surface of the planar antenna 20 is cleaned with the rotation of the stirring means 15. The antenna cleaning member 15*a* is of, for example, a PET (polyethylene terephthalate) sheet, and it rubs the surface of the planar antenna 20.

As shown in FIG. 3, a hole 24 is formed substantially at the center of the planar antenna 20, and the supporting shaft of the stirring means 15 penetrates through the hole 24 to rotatably support the stirring means 15 on the developer accommodating container 4 or the like, so that the surface cleaning means 15*a* can clean almost all of the area of the planar antenna 20.

This is effective to avoid the variations in the measurements attributable to the developer remaining on the planar antenna 20, but the flow of the developer resulting from the rotation of the stirring means 15 causes another variation of the output of the planar antenna 20, which is periodical, in accordance with the rotation of the stirring means 15.

Therefore, the average of the antenna output is taken in accordance with the rotation period of the stirring means 15, or a minimum value is taken (statistic process) to determine the amount of the developer. The signal processing means, namely, the processing means 60 (FIG. 6) are disposed in the main assembly 100 of the image forming apparatus.

A maximum of the range in which a change of the amount of the developer can be detected by the developer remainder detecting means 20 of a flat antenna type device correspond to the state in which the developer is contacted to the whole surface of the planar antenna 20, that is, the state in which the developer is filled up to the height corresponding to the top end of the planar antenna. In this embodiment, the developer remainder in the developer accommodating container 4 can be detected in percentage on the basis of the amount at the time when the level of the developer is higher than the top end of the antenna (100%). In view of the limit of resolution of measurement, the measurement error or the like, the developer remainder can be detected by the decreasing rate of approximately 1%.

Figure 4:
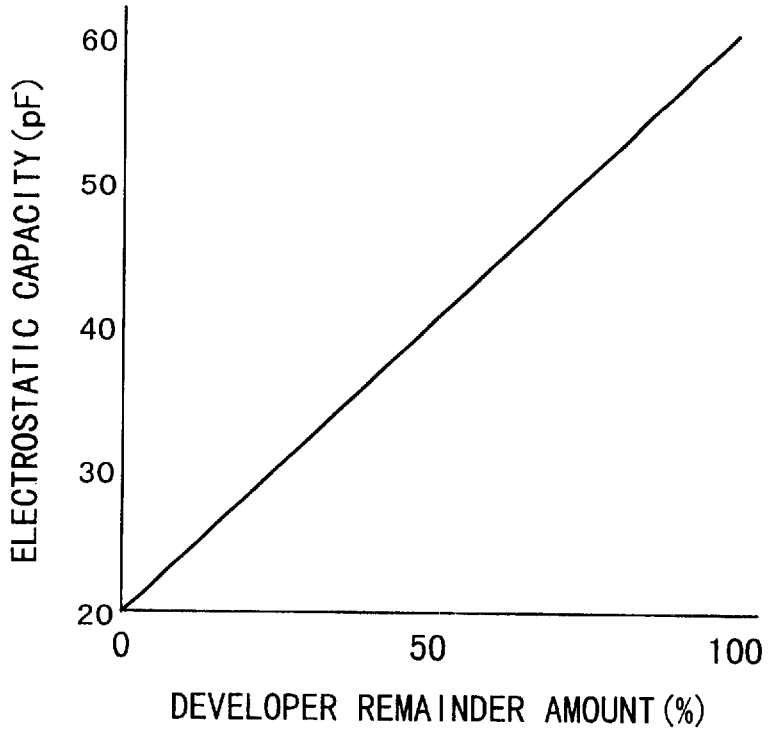
FIG. 4 is a graph showing the relationship between the developer remainder and the electrostatic capacity.

In the case that developer is filled up to the height corresponding to the top end of the planar antenna in this embodiment, the image formation operations are capable of printing 10000 sheets at a 5% print ratio. FIG. 4 shows the relation between the developer remainder and the electrostatic capacity when the maximum detectable range of the amount developer of the developer remainder detecting means 20 is 100%.

Storing Means:

According to this embodiment, the information relating to the nominal lifetime of the process cartridge B can be written in storing means 31 (FIG. 1) provided on the process cartridge B prior to the cartridge shipment, and therefore, even when the cartridges B1, B2 having different nominal lifetimes are exchanged, the developer remainder level in the developer accommodating container 4 can be correctly calculated, and can be notified to the user. By writing the level value of the developer remainder thus calculated in the storing means 31 on the process cartridge B (B1, B2), the cartridges can store the levels of the developer remainders thereof even when the cartridges are exchanged with each other.

Figure 5:
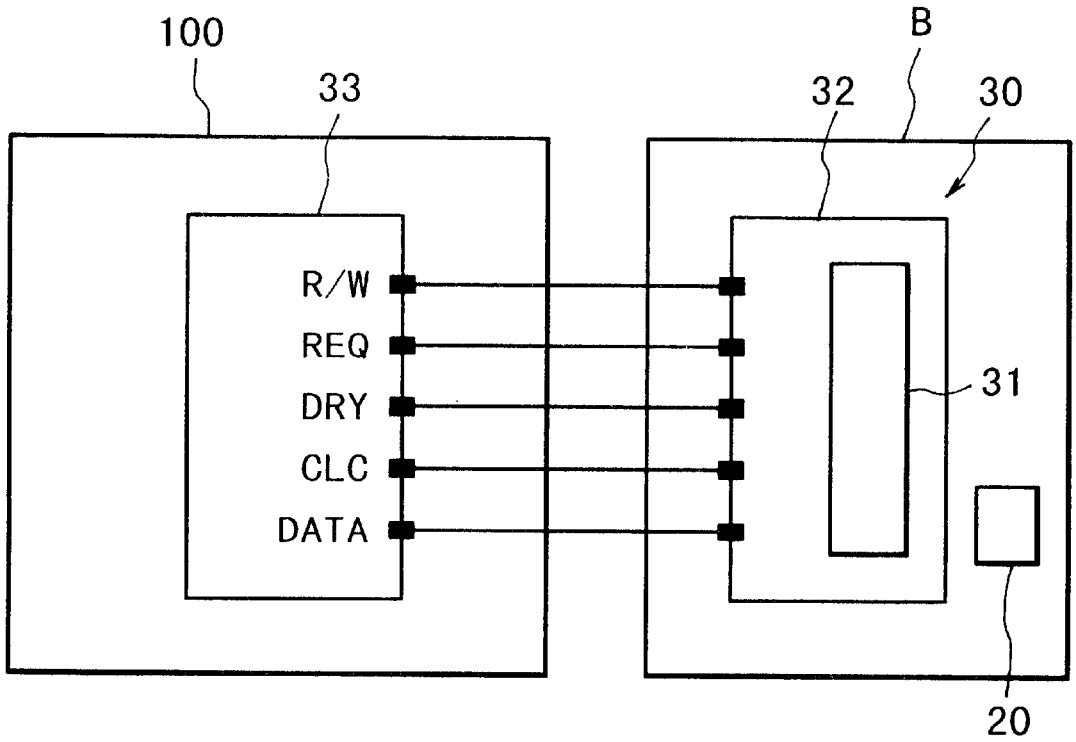
FIG. 5 is an illustration of a storing means provided in a process cartridge according to an embodiment of the present invention.

In this embodiment, as shown in FIG. 5, the process cartridge B is provided with a non-volatile memory 31 as the storing means, and a cartridge side controller 32 for controlling the reading and writing of the information from and in the non-volatile memory 31. When the process cartridge B is mounted to the main assembly 100 of the image forming apparatus, the cartridge side controller 32 and the controller 33 of the main assembly of the image forming apparatus (main assembly side controller 33) are connected through communication lines R/W, REQ, DRY, CLC, DATA. The control means for effecting reading and writing of the information from and in the storing means 31 is constituted by the cartridge side controller 32 and the main assembly side controller 33.

The storing means 31 is in the form of non-volatile memory in this embodiment. However, this is not inevitable, and a volatile memory equipped with a power source is usable, or a non-contact type memory (ferroelectric non-volatile memory (FeRAM) ) that can communicate with the main assembly 100 of the image forming apparatus without necessity of mechanical connection therewith is usable.

When the data is written in or read out of the non-volatile memory 31 (storing means), the proper waiting time is set depending on the properties of the device used to assure the operations thereof.

The non-volatile memory 31 used in this embodiment is serial data entering an output type memory, and the memory capacity is 16 bit. The 16 bit is divided into 8 bit at the front half thereof and 8 bit at the latter part in use. Therefore, the 8 bit regions can store different data.

The information relating to the cartridge's lifetime is written in the front half 8 bit region of the non-volatile memory 31. As described in the foregoing, in this embodiment, the term "nominal lifetime" means the number of sheets on which images can be formed by one process cartridge on the assumption that print ratio is standard for all images (5%).

In this embodiment, the number of recording sheets are expressed in a centuriated unit (with the unit of 100), and the nominal lifetime is settable with the unit of 500. Therefore, the capacity of the front half 8 bit of the non-volatile memory 31 is enough to store a multiple of 5 from 0–1000, that is, the nominal lifetime from 500 sheets to 100000 sheets can be stored with an increment of 500. If a larger lifetime is to be stored, or the lifetime is to be stored with smaller increments, the capacity of the non-volatile memory may be increased.

Since the nominal lifetime of the process cartridge B2 having a large capacity is 10000 sheets, and therefore, the front half 8 bit of the non-volatile memory 31 stores, 100, and the normal process cartridge B1 stores, 60, since the nominal lifetime is 6000 sheets.

The latter part 8 bit region of the non-volatile memory stores a developer remainder level calculated through a method which will be described hereinafter from the detection output of the flat antenna type developer remainder detecting means 20 and the information relating to the nominal lifetime. The calculated developer remainder is expressed as XX%. So, XX, is written in. A capacity of 8 bit is sufficient to express integers 0–100.

In this embodiment, the level value of the developer remainder and the information relating to the lifetime of the process cartridge are written in the same storing means 31 carried on the process cartridge, so that circuits and parts are commonly used, but this is not inevitable, and separate storing devices may be used. Since the controller for the writing and reading in and from the storing means 31 provided in the image forming apparatus is all provided on the cartridge side, electrical error, noise, or the like, can be suppressed.

Processing Means for Calculating the Level:

As shown in FIG. 6, the processing means 60 for calculating the developer remainder level is provided in the main assembly 100 of the image forming apparatus comprising a controller 61, processing portion 62 and the like.

The controller 61 is effective for communication control among the main assembly 100 of the image forming apparatus, the developer remainder detecting means 20, the storing means 31, processing portion 62 and the displaying means 25, which will be described hereinafter. The processing portion 62 calculates the level of the developer remainder on the basis of the information relating to the nominal lifetime stored in the storing means 31 and the amount of the developer detected by the developer remainder detecting means 20.

A description will be provided as to the calculating method of the developer remainder level in this embodiment.

By the flat antenna type developer amount detecting means 20 in the process cartridge B (B1, B2) in this embodiment as described hereinbefore, the developer remainder developer accommodating container 4 is detected as a percentage on the basis of the maximum detectable range of the amount of the developer (=100%), the maximum developer remainder being capable of image formation on 10000 sheets with the 5% print ratio original.

The maximum detectable range of the amount of the developer is properly determined on the basis of a configuration or the like of the flat antenna type developer amount detecting means 20, and the number of sheets on which image formation is capable of being performed with a 5% print ratio original with the amount of the developer corresponding to the maximum detectable range, and changes correspondingly.

Figure 7:
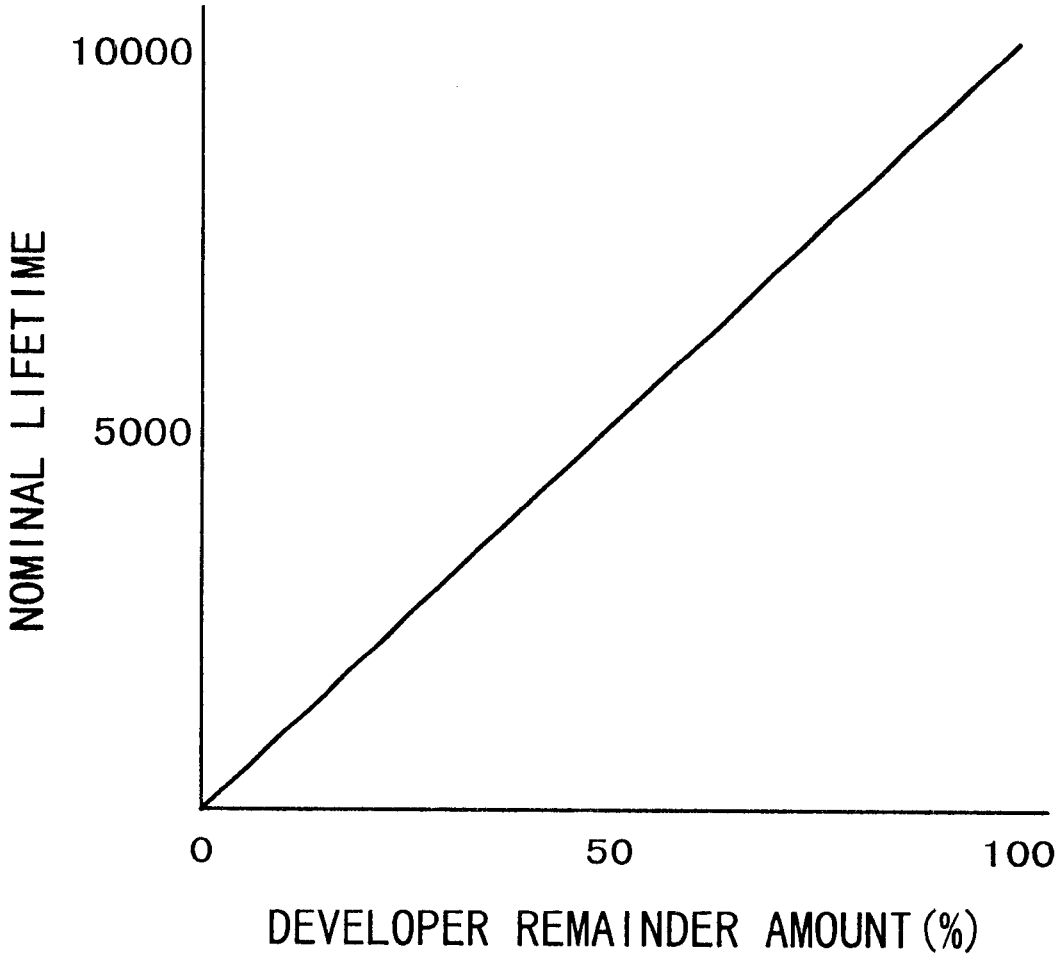
FIG. 7 is a graph showing the relationship between the developer remainder and the nominal lifetime.

Generally, the relation between the amount of the developer and the printable number of sheets at the 5% print ratio (that is, nominal lifetime) is a proportional (one next formula) relation as shown in FIG. 7.

In order to discriminate and to correctly display the level of the developer remainder, when the detection output of the developer amount detecting means 20 is X(%) in a process cartridge having information Y relating to the nominal lifetime stored in the storing means 31, the developer remainder level A level A(%) of the process cartridge is calculated by the following formula:

$$A(\%)=X(\%)\times 10000/(Y\times 100) \quad (1)$$

In formula (1), "10000" is the number of sheets on which images can be formed from the 5% print ratio originals with the 100% amount of the developer corresponding to the maximum detectable range and which has been determined depending on the configuration or the like of the flat antenna type developer amount detecting means 20.

The level of the developer remainder thus calculated is written in the storing means 31 carried on the process cartridge by way of the controller 61. Simultaneously, it is notified to the user in the displaying means 25 connected with the controller 61. Alternatively, the signal relating to the level of the developer remainder thus calculated may be transmitted to a personal computer communicable with the image forming apparatus and may be displayed on a display of a personal computer. As described in the foregoing, the displaying means 25 is able to display the information on the display provided in the main assembly 100 of the apparatus, and it can be outputted on the recording material P.

Figure 8:
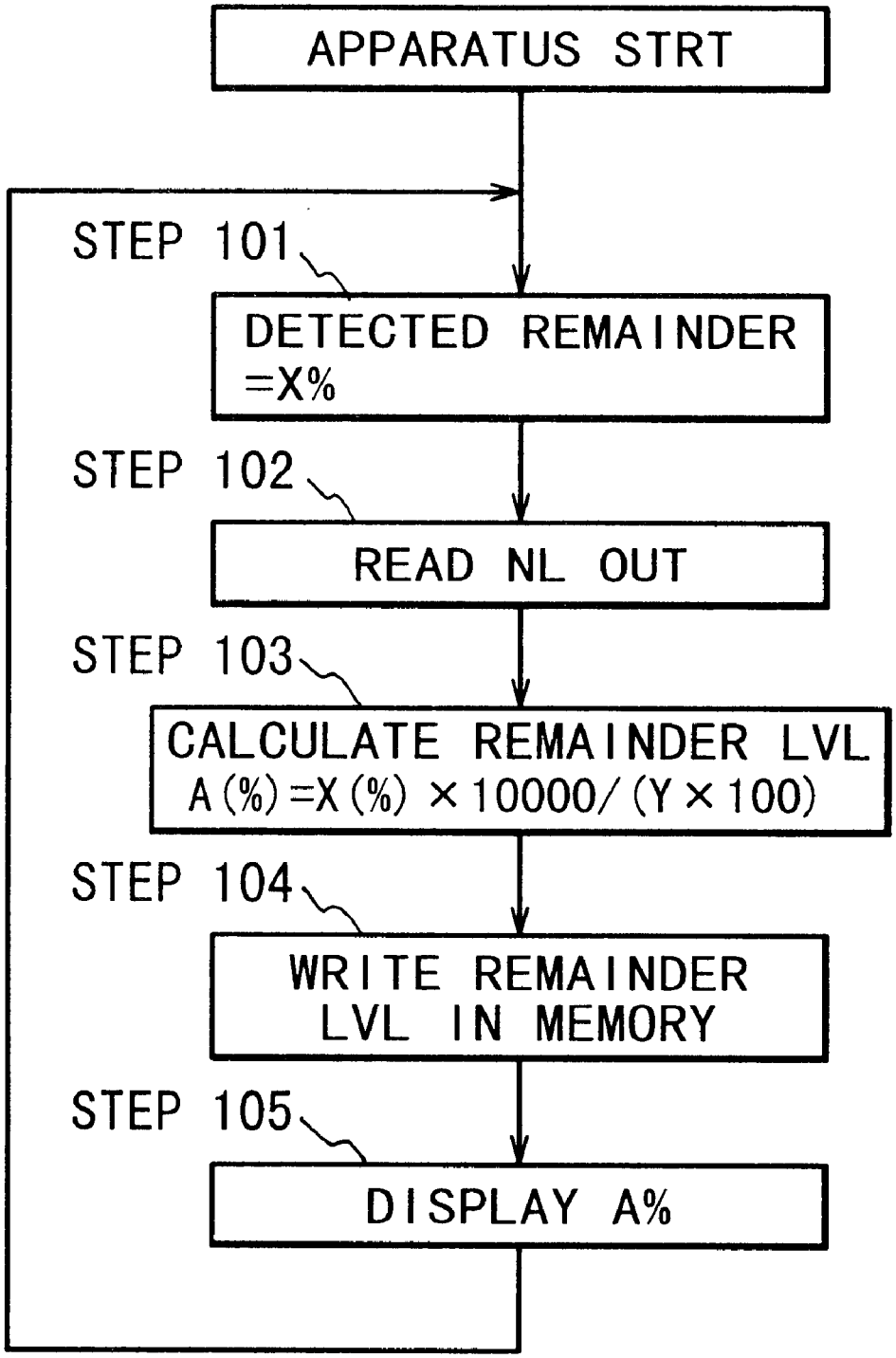
FIG. 8 is a flow chart illustrating an operation for displaying a developer remainder level-according to an embodiment of the present invention.

Referring to a flow chart of FIG. 8, a description will be provided as to the operation of the image forming apparatus according to this embodiment. For a better understanding, a description will be provided on the basis of the starting point, which is the time when the developer detecting device 30, that is, the developer remainder detecting means 20 detects the change of the developer remainder.

Step 101:

The flat antenna type developer remainder detecting means 20 detects that developer remainder in the developer accommodating container 4 is X% at present.

Step 102

The information Y relating to the nominal lifetime written in the front half 8 bit of the non-volatile memory 31 (the storing means provided on the process cartridge).

Step 103:

The developer remainder level A% is calculation, using formula (2).

$$A(\%)=X(\%)\times 10000/(Y\times 100) \quad (2)$$

Step 104:

The calculated Level A% of the developer remainder is written in the latter part 8 bit of the non-volatile memory 31 (the storing means provided on the process cartridge).

Step 105:

The displaying means 25 or the display of the personal computer displays "Developer Remainder=A%".

The operation goes back to the step 101, and the above-described operations are repeated whenever the developer remainder detecting means 20 detects the change of the developer remainder.

By repeating the above-described operations, the remaining amount display level of the cartridge B1 in which the toner is filled only up to approximately 60% of the full height of the flat antenna before start of use of the process cartridge, is 100 percent, so that user is not confused. The remaining amount display level of the cartridge B2 before start of use thereof is also 100%.

In the case that the same images are outputted (the same consumption of toner), the amount of decrease of the remaining amount display level is smaller in the cartridge B2 having the larger capacity than in the cartridge B1.

When, for example, the cartridge B1 is mounted, the remaining amount display level is 100% when the output of the remaining amount detecting means 20 is 60% (X=60), and the remaining amount display level is approximately 83% when the output of the remaining amount detecting means 20 is 50% (X=50), and the decrease amount of the remaining amount display level is minus 17.

On the other hand, when the cartridge B2 is mounted, the remaining amount display level is 60% when the output of the remaining amount detecting means 20 is 60% (X=60), and the remaining amount display level is approximately 50% when the output of the remaining amount detecting means 20 is 50% (X=50), and the decrease of the amount of the remaining amount display level is minus 10. When the consumption is the same, the amount of decrease of the remaining amount display level when the cartridge B2 is mounted, is smaller than that when the cartridge B1 is mounted.

In other words, the amount of change of the remaining amount display level on the display per unit consumption of the developer is smaller for the cartridge B2 having a larger full-amount than for the cartridge B1 having a smaller full-amount.

As described in the foregoing, the amount of the developer in the developer accommodating container 4 detected by the developer remainder detecting means 20 is calculated into a correct developer remainder level for the process cartridge, which may have a different nominal lifetime on the basis of the information relating to the nominal lifetime stored in the storing means 31 carried on the process cartridge. The user is notified of the developer remainder thus calculated, which is stored in the storing means 31 carried on the process cartridge. Thus, even when the cartridges are exchanged, the developer remainder level can be stored for the cartridge.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made of a flat antenna type detector using the electrostatic capacity for the developer remainder detecting means 20, but the present invention is not limited to the use thereof, and another developer remainder detecting means is usable. For example, a plate antenna type device which also is an electrostatic capacity detecting type, a torque detecting type or the like is usable if it can detect the developer remainder.

Embodiment 2

A description will be provided as to a process cartridge B3 having a nominal lifetime of 12000 sheets before the start of use, according to this embodiment. In this embodiment, the term "nominal lifetime" means the number of sheets on which images can be formed by one process cartridge on the assumption that the print ratio is standard for all images (5%).

Similarly to the process cartridge B1 and the process cartridge B2 described with Embodiment 1, the process cartridge B3 has the same configuration and is detachably mountable to the same main assembly 100 of the image forming apparatus, except that amount of the developer filled in the developer accommodating container 4 is different. There is provided a developer amount detecting device 30 which is provided with developer remainder detecting means 20 capable of substantially real time detection of the remaining amount with the consumption of the developer T in the developer accommodating container 4. There are further provided storing means for storing the information relating to the lifetime of the process cartridge and storing means for storing the level of the developer remainder. In this embodiment, similarly to Embodiment 1, the storing means is the same as the storing means 31.

The image forming apparatus is the same as with Embodiment 1, and is provided with processing means 60 for calculating the developer remainder level on the basis of the result of detection of the developer remainder detecting means 20 and the information relating to the lifetime of the process cartridge stored in the storing means 31, and with means 25 for displaying the developer remainder level. The level of the developer remainder may be outputted to a personal computer communicable with the image forming apparatus and may be displayed on the display of the personal computer.

The developer remainder detecting means 20 has the same configuration as with Embodiment 1. Therefore, the maximum detectable range of the change of the amount of the developer of the developer remainder detecting means 20 corresponds to the developer contacting the whole surface of planar antenna 20. In Embodiment 2, the image formation is capable of printing 10000 sheets at a print ratio of 5% when the amount of the developer is at the maximum detectable range of the developer remainder detecting means 20.

The storing means 31 and the processing means 60 calculating the developer remainder level are similar to Embodiment 1, and therefore, the detailed description thereof is omitted.

A description will be provided as to the calculating method of the developer remainder level in this embodiment.

In the process cartridge and the flat antenna type developer amount detecting means 20 in this embodiment, the developer remainder is detected in a percentage on the basis of 100% being equal to the amount of the developer at the maximum detectable range, and the maximum developer remainder is capable of image formations on 10000 sheets having 5% print ratio originals.

Therefore, in the process cartridge B3 having the nominal lifetime of 12000 sheets, the amount of the developer which is larger than the maximum detectable developer remaining amount of the detecting means 20 is present in the developer accommodating container 4. When image formations are carried out for 5% print ratio originals, the developer amount detecting means 20 keeps detecting a 100% amount of developer from 12000 sheets to 10000 sheets, since the amount of the developer is larger than the detectable range of the change of the remaining amount of the developer amount detecting means 20.

In this embodiment, while the amount of the developer that is larger than the detectable range of the developer amount detecting means 20 is in the developer accommodating container 4, the user is notified that the developer remainder level is 100%, which is stored in the storing means 31 carried on the process cartridge.

For the amount of the developer within the detectable range of the developer remainder by the developer amount detecting means 20, similarly to Embodiment 1, the developer remainder level A(%) of the process cartridge is calculated through the following formula when the information relating to the nominal lifetime stored in the storing means 31 is Y, and the detection output of the detecting means 20 of the developer amount is X(%):

$$A(\%)=X(\%)\times 10000/(Y\times 100) \quad (3)$$

By the consumption of the developer due to image formations, the developer remainder falls within the detectable range, and when, for example, the detection output of the developer amount detecting means becomes 99%, the developer remainder level of the process cartridge is as follows from formula (3):

$$A(\%)=99\times/(120\times 100)=83\%:$$

In formula (3), "10000" is the number of sheets on which images can be formed from 5% print ratio originals with the 100% amount of developer corresponding to the maximum detectable range, which has been determined depending on the configuration or the like of the flat antenna type developer amount detecting means 20.

The calculated developer remainder level is written in the storing means 31 carried on the process cartridge by way of the controller 61. Simultaneously, the user is notified of this information by the displaying means 25 connected with the controller 61.

Alternatively, the signal relation to the level of the developer remainder thus calculated may be transmitted to a personal computer communicable with the image forming apparatus and may be displayed on a display of a personal computer.

Figure 9:
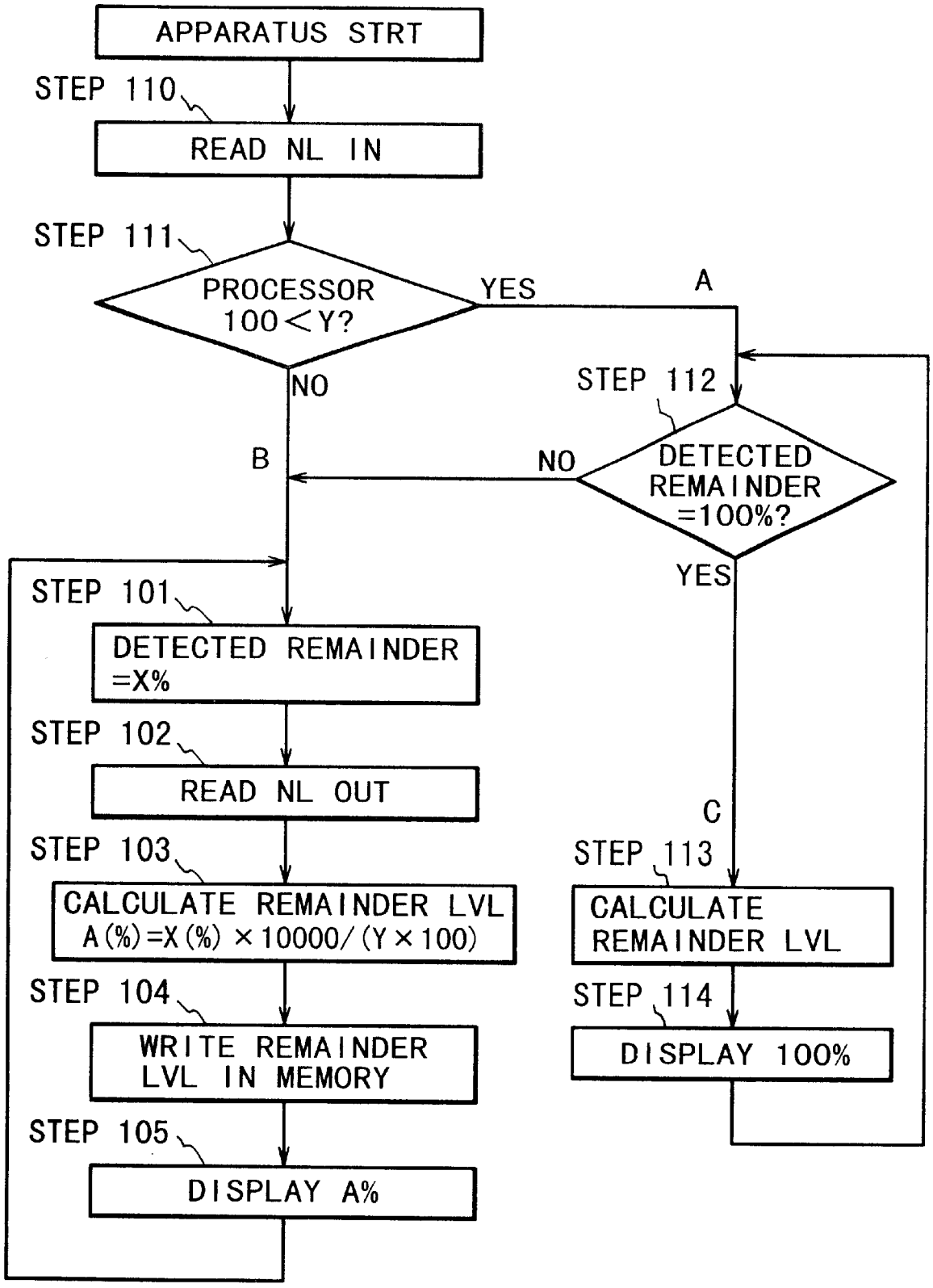
FIG. 9 is a flow chart illustrating an operation for displaying a developer remainder level according to another embodiment of the present invention.

Referring to a flow chart of FIG. 9, a description will be provided as to the operation of the image forming apparatus of this embodiment.

Step 110:

The information Y relating to the nominal lifetime of the process cartridge mounted to the image forming apparatus is read out of the storing means carried on the process cartridge, and more particularly, the front half 8 bit of the non-volatile memory 31.

Step 111:

The processing portion 62 discriminates whether or not the information Y read out of the storing means 31 is larger than the printable number of the images from 5% print ratio original at the 100% maximum developer amount of the detectable range determined on the basis of the configurations or the like of the process cartridge and the flat antenna type developer amount detecting means 20 of this embodiment, namely, the nominal lifetime 10000. If so (YES), the operation proceeds to A, and if not (NO), it goes to B.

When it is larger (YES):

Step 112:

The discrimination is made as to whether or not the developer remainder detected by the flat antenna type developer remainder detecting means 20 is 100%. If so (YES), the operation goes to C. If not (99% or lower), the operation goes to B. When it is 100% (YES), the operation goes to C.

Step 113:

The developer remainder level 100% is written in the latter part 8 bit of the storing means carried on the process cartridge, namely, non-volatile memory 31.

Step 114:

The display of the personal computer and the display displays developer remainder=100%.

The operation goes back to step 112, and the discrimination is made as to whether or not the developer remainder detected by the flat antenna type developer remainder detecting means 20 is 100%. If smaller (NO), the operation goes to B.

The subsequent process steps 101–105 are the same as the steps 101–105 of Embodiment 1, and therefore, the descriptions thereof omitted.

As described in the foregoing, the amount of the developer in the developer accommodating container 4 detected by the developer remainder detecting means 20 is calculated into a correct developer remainder level for the process cartridge that may have a different nominal lifetime on the basis of the information relating to the nominal lifetime stored in the storing means 31 carried on the process cartridge. The developer remainder level calculation in this manner is notified to the user and is stored in the storing means 31 carried on the process cartridge. Thus, even when the cartridge are exchanged, the developer remainder level can be stored for the cartridge.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made of a flat antenna type using electrostatic-capacity detection for the developer remainder detecting means 20, but the present invention is not limited to the use thereof, and another developer remainder detecting means is usable, similarly to Embodiment 1.

Embodiment 3

In this embodiment, the amount of the developer is written in the storing means 31 carried on the process cartridge as information relating to the lifetime of the cartridge.

The developer accommodating container 4 is filled with developer so as to meet the nominal lifetime. The nominal lifetime described in Embodiment 1 and the amount of the filled developer described in this embodiment are in one to one relation to each other.

The process cartridge B usable in this embodiment may either be a normal process cartridge B1 which has the nominal lifetime 6000 sheets and which contains 600 g of the developer and a large capacity process cartridge B2 which has the nominal lifetime 10000 sheets and which contains 1000 g of the developer. In this embodiment, the term "Nominal lifetime" means the number of sheets on which images can be formed by one process cartridge on the assumption that the print ratio is standard for all images (5%). The process cartridges have the same configuration and are detachably mountable to the same main assembly 100 of the image forming apparatus, except that the amounts of the developer filled in the developer accommodating container 4 are different.

Similarly to the Embodiment 1, the process cartridge B is provided with a developer amount detecting device 30 provided with a developer remainder detecting means 20 capable of substantially real-time detection of the remaining amount in accordance with the consumption of developer T in the developer accommodating container 4. Furthermore, there are provided storing means for storing the information relating to the amount of the developer filled in the process cartridge (the information relating to the cartridge lifetime) and storing means for storing the level of the developer remainder. In this embodiment, similarly to Embodiment 1, the storing means is the same as the storing means 31.

Similarly to Embodiment 1, the image forming apparatus is provided with processing means 60 for calculating the level of the developer remainder on the basis of the result of detection of the developer remainder detecting means 20 and the information relating to the developer amount filled in the process cartridge stored in storing means 31, and means 25 for displaying the calculated developer remainder level. The level of the developer remainder may be outputted to the personal computer communicable with the image forming apparatus and may be displayed on the display of the personal computer.

The description is omitted for simplicity as to the portions which are the same as with Embodiment 1. In this embodiment, the weight of the developer filled in the process cartridge is written in the front half 8 bit area of the non-volatile memory 31, which is the storing means.

In this embodiment, the weight of the developer filled therein is expressed with the unit of 10 g, and the developer weight can be set with the unit of 50 g. Therefore, the front half 8 bit of the non-volatile memory 31 is enough to store a multiple of 5 in the range of 0–1000, and the weight of the developer can be stored with increment of 50 g from 50 g to 10000 g. In order to store a larger weight of the developer or with a small increment of the weight, the capacity of the non-volatile memory may be increased.

A description will be provided as to the calculating method of the developer remainder level in this embodiment.

Similarly to Embodiment 1, in the process cartridge according to this embodiment and the flat antenna type developer amount detecting means 20, the developer remainder in the developer accommodating container 4 is detected as a percentage on the basis of the maximum detectable range of the amount of the developer being 100%, and with the maximum developer remainder, the image formation is capable on 10000 sheets from 5% print ratio originals, and the weight of the developer is 1000 g.

In the process cartridge having the information Z relating to the weight of the filled developer stored in the storing means 31, when the detection output of the detecting means 20 for detecting the amount of the developer is X(%), the developer remainder level A(%) of the process cartridge is calculated using the following formula:

$$A(\%)=X(\%)\times 1000/(Z\times 10) \quad (4)$$

In formula (3), "1000" is the weight of the developer corresponding to the 100% amount (1000 g) of the developer corresponding to maximum of the detectable range and which has been determined depending on the configuration or the like of the flat antenna type developer amount detecting means 20.

The calculated developer remainder level is written in the storing means 31 carried on the process cartridge by way of the controller 61 of the processing means 60. Simultaneously, the user is notified of the information in the displaying means 25 connected to the controller 61. Alternatively, the signal relating to the level of the developer remainder thus calculated may be transmitted to a personal computer communicable with the image forming apparatus and may be displayed on a display of a personal computer.

As described in the foregoing, the correct developer remainder level is calculated for the process cartridge having different filled amount of the developer from the developer amount in the developer accommodating container 4 detected by the developer remainder detecting means 20 and the information filling to the developer amount filled in the cartridge stored in the storing means 31 carried on the process cartridge. The level of the developer remainder thus calculated, is notified to the user, and is stored in the storing means 31 carried on the process cartridge. Thus, even when the cartridge is exchanged, the developer remainder level can be stored for the cartridge.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made of a flat antenna type device which is an electrostatic capacity detecting type detector, for the developer remainder detecting means 20, but the present invention is not limited to the use thereof, and another type developer remainder detecting means 20 is usable.

Embodiment 4

In this embodiment, the detection output of the flat antenna type developer remainder detecting means 20 is stored in the storing means 31 carried on the process cartridge. The description is omitted for simplicity as to the portions which are the same as with Embodiment 1.

The process cartridge B of the embodiment, similarly to the description in Embodiment 1, may either be a normal process cartridge B1 having a nominal lifetime of 6000 sheets and a large capacity process cartridge B2 having a nominal lifetime of 10000 sheets. Such process cartridges have the same configuration and are detachably mountable to the same main assembly 100 of the image forming apparatus, except that the amounts of the developer filled in the developer accommodating container 4 are different.

The process cartridges B1, B2 are provided with a developer amount detecting device 30 provided with developer remainder detecting means 20 for substantially real-time detection of the remaining amount in accordance with the consumption of the developer T in the developer accommodating container 4. There are provided storing means for storing the information relating to the lifetime of the process cartridge and storing means for storing the result of detection of the developer remainder detecting means. In this embodiment, similarly to Embodiment 1, the storing means is the same as the storing means 31.

The image forming apparatus is provided with processing means 60 for calculating the developer remainder level on the basis of the result of detection of the developer remainder detecting means 20 and the information relating to the lifetime of the process cartridge stored in the storing means 31, and with means 25 for displaying the developer remainder level. The level of the developer remainder may be outputted to the personal computer communicable with the image forming apparatus and may be displayed on the display of the personal computer.

The developer remainder detecting means 20 can detect the developer remainder in the developer accommodating container 4 in percentage on the basis of the maximum developer amount in the detectable range being 100%. In consideration of the limit of the resolving power of the measurement and the measurement error or the like, the developer remainder can be detected with the unit of the decreasing rate of 1%.

The developer remainder which is the detection output of the flat antenna type developer remainder detecting means 20 is written in the latter part 8 bit region of the non-volatile memory 31, which is the storing means described in Embodiment 1. As described, the developer remainder is detected as XX%. Then, the value XX is written in. The capacity of 8 bit is enough to express an integer in the range of 0–100.

In order to discriminate process cartridges having different lifetimes and to display the developer remainder levels, the developer remainder level A(%) of the process cartridge is calculated by the following formula when the information relating to the nominal lifetime stored in the storing means 31 carried on the process cartridge is Y, and the detection output of the developer amount detecting means 20 carried on the process cartridge is X(%).

$$A(\%)=X(\%)\times 10000/(Y\times 100) \quad (5)$$

In formula (5), "10000" is the number of sheets on which images can be formed from 5% print ratio originals with the 100% amount of the developer corresponding to maximum detectable range and which has been determined depending on the configuration or the like of the flat antenna type developer amount detecting means 20.

The calculated developer remainder level is notified to the user on the displaying means 25 connected to the controller 61 of the processing means 60. Alternatively, the signal relating to the level of the developer remainder thus calculated may be transmitted to a personal computer communicable with the image forming apparatus and may be displayed on a display of a personal computer.

Figure 10:
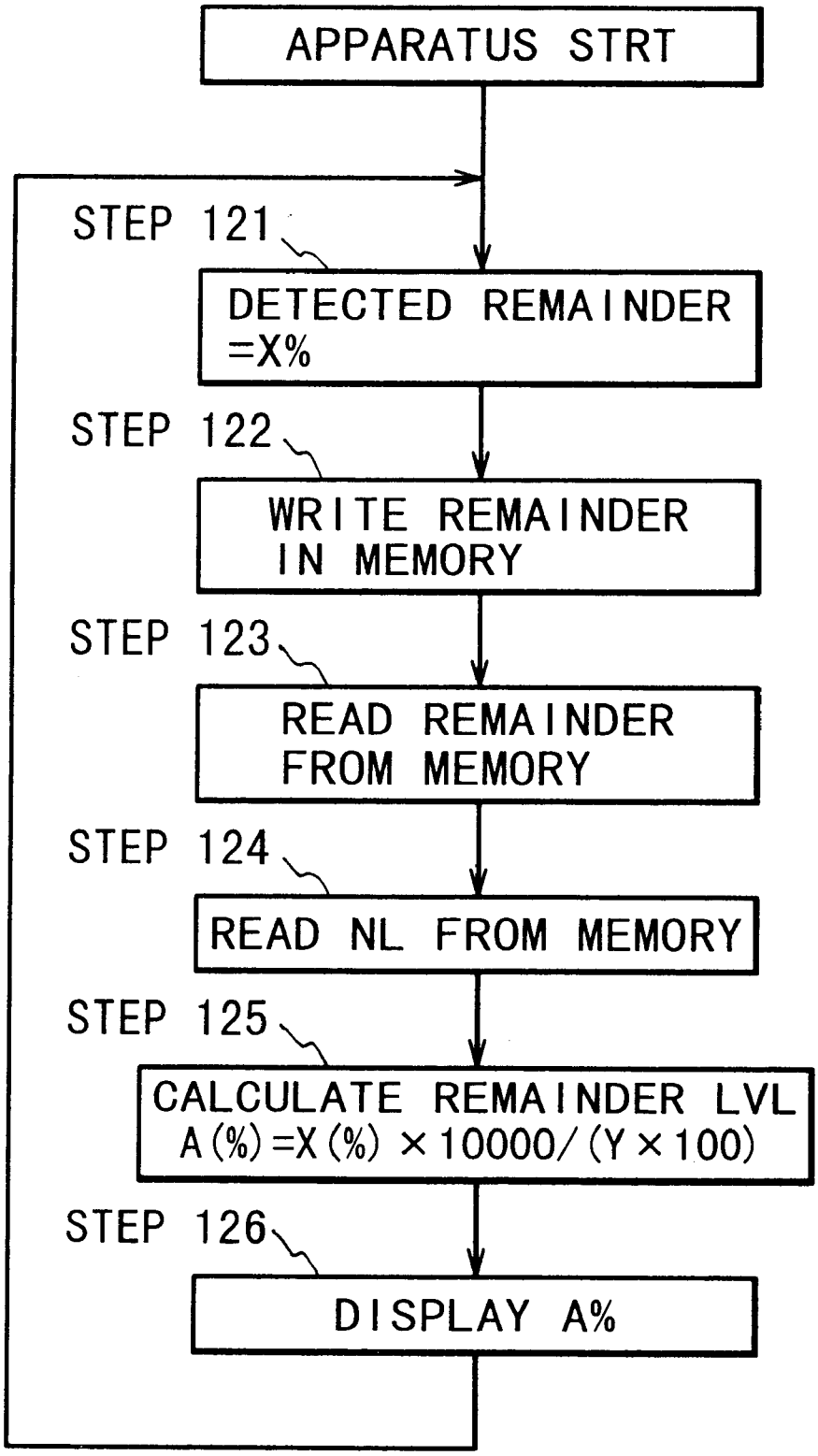
FIG. 10 is a flow chart illustrating an operation for displaying a developer remainder level according to a further embodiment of the present invention.

Referring to a flow chart in FIG. 10, a description will be provided as to the operation of the image forming apparatus of this embodiment.

For the better understanding, a description will be provided on the basis of the starting point which is the time when the developer detecting device 30, that is, the developer remainder detecting means 20 detects the change of the developer remainder.

Step 121:

The flat antenna type developer remainder detecting means 20 detects that developer remainder in the developer accommodating container 4 is X% at present.

Step 122:

The developer remainder=X% detected by the developer remainder detecting means 20 is written in the latter part 8 bit of the non-volatile memory 31, that is, the storing means carried on the process cartridge.

Step 123:

The developer remainder X written in the storing means carried on the process cartridge, namely, the latter part 8 bit of the non-volatile memory 31 is read out.

Step 124:

The information Y relating to the nominal lifetime written in the front half 8 bit of the non-volatile memory 31, namely, the storing means carried on the process cartridge is read out.

Step 125:

The developer remainder Level A% is calculated by formula (6).

$$A(\%)=X(\%)\times 10000/(Y\times 100) \quad (6)$$

Step 126:

The displaying means 25 or the display of the personal computer displays "Developer Remainder=A%".

The operation returns to step 121, if the developer remainder detecting means 20 detects a change of the developer remainder, and the above-described is repeated.

As described in the foregoing, the developer amount in the developer accommodating container 4 detected by the developer remainder detecting means 20 is written substantially in real time in the storing means 31 carried on the process cartridge, and the correct developer remainder level can be calculated for process cartridges having different capacities on the basis of the amount of the developer thus written in and the information relating to the nominal lifetime stored beforehand. The calculated developer remainder level is notified to the user.

By writing substantially in real time the amount of the developer in the developer accommodating container 4 detected by the developer remainder detecting means 20 in the storing means 31 carried on the process cartridge, so that the amount of the developer in the developer accommodating container 4 in the process cartridge is stored, the developer remainder level of the cartridge can be displayed even when the cartridges are exchanged.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made of a flat antenna type using electrostatic-capacity detection the developer remainder detecting means 20, but the present invention is not limited to the use thereof, and another developer remainder detecting means is usable, similarly to Embodiment 1.

Embodiment 5

In this embodiment, the structures of the image forming apparatus and the process cartridge are the same as those described in Embodiment 1, and the description thereof is omitted for simplicity.

The process cartridge B of this embodiment, similarly to Embodiment 1, may either be a normal process cartridge B1 having a nominal lifetime 6000 sheets, and a large capacity process cartridge B2 having a nominal lifetime 10000 sheets. In this embodiment, the term "Nominal lifetime" means the number of sheets on which images can be formed by one process cartridge on the assumption that print ratio is standard for all images (5%). The process cartridges have the same configuration and are detachably mountable to the same main assembly 100 of the image forming apparatus, except that the amounts of the developer filled in the developer accommodating container 4 are different.

The process cartridges B1, B2 are provided with a developer amount detecting device 30 provided with developer remainder detecting means 20 for substantially real-time detection of the remaining amount in accordance with the consumption of the developer T in the developer accommodating container 4. By doing so, the user can be notified of the developer remainder level in the developer accommodating container 4 in substantially real time, and a warning (toner LOW warning) can be produced when the developer remainder is reduced, and the time of process-cartridge exchange approaches. There are further provided storing means for storing the information relating to the lifetime of the process cartridge and storing means for storing the level of the developer remainder. In this embodiment, similarly to Embodiment 1, the storing means is the same as the storing means 31.

In this embodiment, the image forming apparatus is provided with processing means 60 for calculating a developer remainder level on the basis of the information relating to the nominal lifetime of the process cartridge stored individually in the storing means 31 and the result of detection of the developer remainder detecting means 20, means for discriminating whether or not the toner LOW warning is to be produced based on the detected developer amount, and means 25 for displaying the level of the developer remainder thus calculated. The level of the developer remainder may be outputted to the personal computer communicable with the image forming apparatus and may be displayed on the display of the personal computer.

A description will be provided as to the means.

Developer Remainder Detecting Means:

Similarly to Embodiment 1, the developer remainder detecting device 30 is provided in the process cartridge and is an electrostatic capacity detecting type means having a planar antenna (developer remainder detecting means 20). The developer remainder detecting means 20 is the same as that in Embodiment 1, and therefore, the detailed description thereof is omitted.

Therefore, the maximum detectable range of the change of the amount of the developer of the developer remainder detecting means 20 corresponds to the developer contacting the whole surface of planar antenna 20 in this embodiment, too. The developer remainder detecting means 20 can detect the developer remainder in the developer accommodating container 4 in a percentage on the basis of the maximum developer amount in the detectable range being 100%. In consideration of the limit of the resolving power of the measurement and the measurement error or the like, the developer remainder can be detected with the unit of the decreasing rate of 1%.

In this embodiment, the image formation is capable on 10000 sheets at the print ratio of 5% with the amount of the developer corresponding to the maximum of the detectable range of the developer remainder detecting means 20.

Storing Means:

In this embodiment, similarly to Embodiment 1, the information relating to the nominal lifetime of the process cartridge is written in the storing means 31 carried on the process cartridge B prior to cartridge shipment, so that even when the cartridges having different nominal lifetimes are exchanged and used, the developer remainder level in the developer accommodating container 4 can be correctly notified to the user, and in addition, by writing the developer remainder level in the storing means 31 carried on the process cartridge B, the developer remainder level of the cartridge can be stored or memorized even when the cartridges are exchanged and used.

In this embodiment, as shown in FIG. 5, the process cartridge B is provided with non-volatile memory 31 as the storing means, and a cartridge side controller 32 for controlling writing and reading of the information in and from the non-volatile memory 31. When the process cartridge B is mounted to the main assembly 100 of the image forming apparatus, the cartridge side controller 32 and the controller 33 of the main assembly of the image forming apparatus (main assembly side controller 33) are connected through communication lines R/W, REQ, DRY, CLC, DATA. The control means to effect reading and writing of the information from and in the storing means 31 is constituted by the cartridge side controller 32 and the main assembly side controller 33.

The storing means 31 is in the form of non-volatile memory in this embodiment. However, this is not inevitable, and a volatile memory equipped with a power source is usable, or non-contact type memory, (ferroelectric non-volatile memory (FeRAM) ) which can communicate with the main assembly 100 of the image forming apparatus without necessity of mechanical connection therewith, is usable.

When the data is written in or read out of the non-volatile memory 31 (storing means), a proper waiting time is set depending on the properties of the device used to assure the operations thereof.

The non-volatile memory 31 used in this embodiment is a serial data entering output type memory, and the memory capacity is 16 bit. The 16 bit is divided into 8 bit at the front half thereof and 8 bit at the latter part in use. Therefore, the 8 bit regions can store different data.

The information relating to the lifetime is written in the front half 8 bit region of the non-volatile memory 31. As described in the foregoing, in this embodiment, the term "Nominal lifetime" means the number of sheets on which images can be formed by one process cartridge on the assumption that print ratio is standard for all images (5%).

In this embodiment, the number of recording sheets are expressed in a centuriated unit, and the nominal lifetime is settable with a unit of 500 sheets. Therefore, the capacity of the front half 8 bit of the non-volatile memory 31 is enough to store a multiple of 5 from 0–1000, that is, the nominal lifetime from 500 sheets to 100000 sheets can be stored with an increment of 500. If a larger lifetime is to be stored, or the lifetime is to be stored with smaller increments, the capacity of the non-volatile memory may be increased. Since the nominal lifetime of the process cartridge B2 having the large capacity is 10000 sheets, the front half 8 bit of the non-volatile memory 31 stores, 100, and the normal process cartridge B1 stores, 60, since the nominal lifetime is 6000 sheets.

In the latter part 8 bit region of the non-volatile memory, a developer remainder level is calculated through a method that will be described hereinafter from the detection output of the flat antenna type developer remainder detecting means 20 and the information relating to the nominal lifetime. The calculated developer remainder is expressed as XX%. So, XX, is written in. The capacity of 8 bit is enough to express an integer in the range of 0–100.

In this embodiment, the level value of the developer remainder and the information relating to the lifetime of the process cartridge are written in the same storing means 31 carried on the process cartridge, so that circuit and parts are commonly used, but this is not inevitable, and separate storing devices may be used. Since the controller for the writing and reading in and from the storing means 31 provided in the image forming apparatus is all provided on the cartridge side, the electrical error, noise or the like can be suppressed.

The processing means 60 comprises processing means for calculating the developer remainder level, the means for discriminating whether to produce a toner LOW warning, for calculating the developer remainder level, and the means for discriminating the warning, provided in the main assembly 100 of the image forming apparatus, as shown in FIG. 6, comprises a controller 61 and a processing portion 62.

The controller 61 communicates with the main assembly 100 of the image forming apparatus, the developer remainder detecting means 20, the storing means 31, the processing portion 62 and the displaying means 25, which will be described hereinafter, and so on, and controls them. The processing means 60 calculates the level of the developer remainder on the basis of the information relating to the nominal lifetime stored in the storing means 31 and the amount of the developer detected by the developer remainder detecting means 20, and simultaneously, it discriminates whether to produce a toner LOW warning.

A description will be provided as to the calculating method of the developer remainder level and the timing of producing the toner LOW in this embodiment.

In the process cartridge and the flat antenna type developer amount detecting means 20 in this embodiment, the developer remainder is detected in a percentage on the basis of 100% equal to the amount of the developer at the maximum detectable range, and the maximum developer remainder is capable of image formations on 10000 sheets from 5% print ratio originals.

The maximum amount of the developer within the detectable range is properly determined depending on the configurations or the like of the process cartridge and the flat antenna type developer amount detecting means 20, and the number of sheets on which the image can be formed from the 5% print ratio original with the maximum amount of the developer within the detectable range changes corresponding thereto.

The toner LOW warning is produced at 5% (X=5) on the basis of the maximum amount of the developer within the detectable range of the developer remainder detecting means 20 being 100% in this embodiment. With the developer remainder of 5% it is enough for image formations on 500 sheets from 5% print ratio originals, so that user is given time before the exchange of the process cartridge, the time corresponding to image formations on sheets contained in 1 cassette which has a capacity of 500 sheets.

In order to discriminate process cartridges having different nominal lifetimes and to display the developer remainder levels, the developer remainder level A(%) of the process cartridge is calculated by the following formula when the information relating to the nominal lifetime stored in the storing means 31 carried on the process cartridge is Y, and the detection output of the developer amount detecting means 20 carried on the process cartridge is X(%).

$$A(\%)=X(\%)\times 10000/(Y\times 100) \quad (7)$$

In formula (6), "10000" is the number of sheets on which images can be formed from the 5% print ratio originals with the 100% amount of the developer corresponding to maximum detectable range and which has been determined depending on the configuration or the like of the flat antenna type developer amount detecting means 20.

In this embodiment, the toner LOW warning is produced when X=5, for the normal process cartridge B1 having the nominal lifetime of 6000 sheets and for the large capacity process cartridge B2 having the nominal lifetime of 10000 sheets. Then, the remaining amount display level when the toner LOW warning is produced is:

For normal process cartridge B1:

$$8\%=5\%\times 10000/(6\times 100):$$

For large capacity process cartridge B2:

$$5\%=5(\%)\times 10000/(10\times 100)$$

Thus, even when process cartridges having different nominal lifetimes are used in the same image forming apparatus, the toner LOW warning notifying the user of the shortage of the developer remainder, that is, a prompt of the exchange of the process cartridge, can be produced at the same timing, that is, the time given to the user until the exchange is the same.

The calculated developer remainder level is written in the storing means 31 carried on the process cartridge by way of the controller 61. Simultaneously, it is communicated to the user in the displaying means 25 connected to the controller 61. Alternatively, the signal relating to the level of the developer remainder thus calculated may be transmitted to a personal computer communicable with the image forming apparatus and may be displayed on a display of a personal computer.

The same applies to the toner LOW warning, and is communicated to the user on the displaying means 25 connected with the controller 61. Alternatively, it may be outputted to a personal computer connectable with the image forming apparatus and displayed on the display of the computer.

Figure 11:
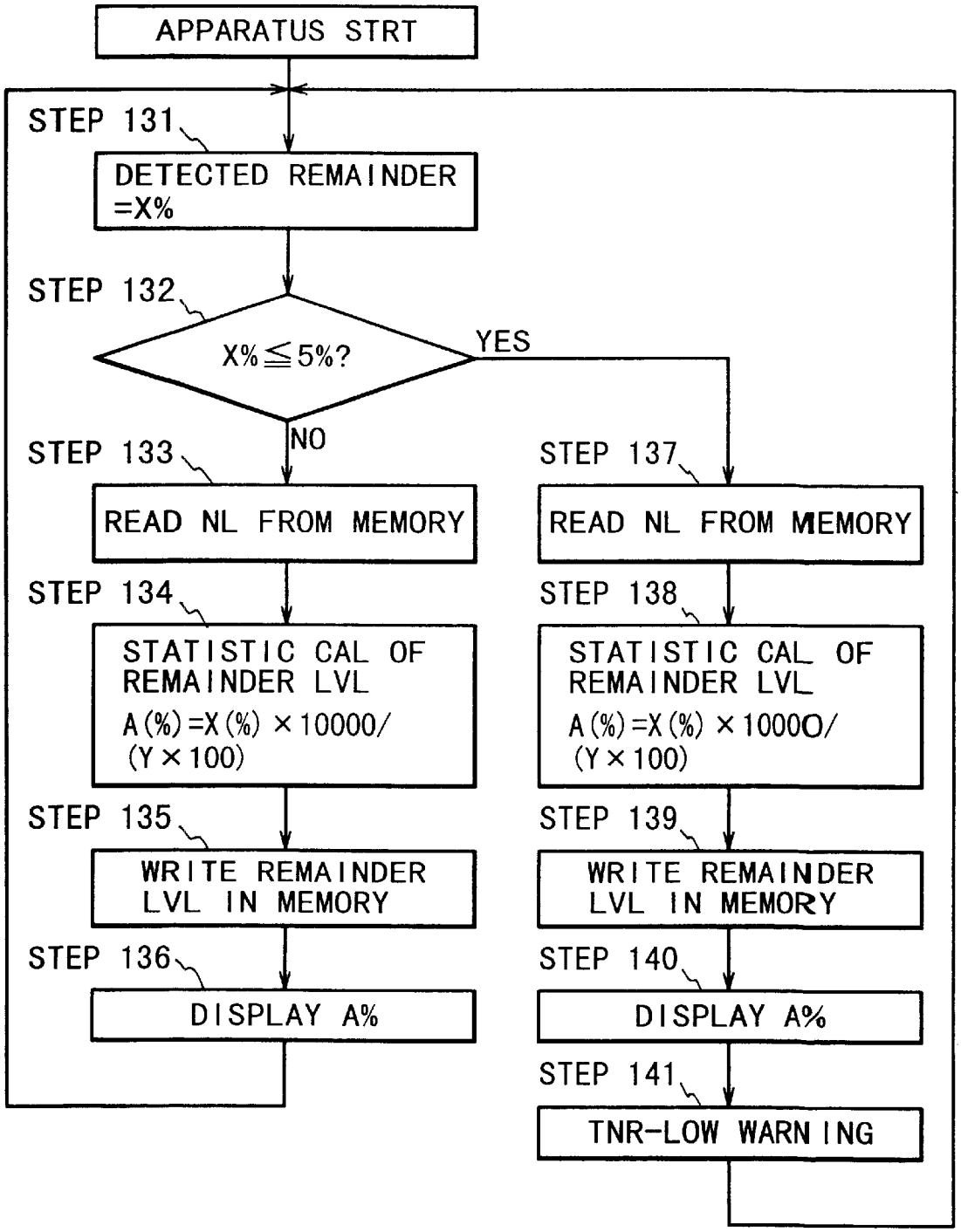
FIG. 11 is a flow chart illustrating an operation for displaying a developer remainder level according to a further embodiment of the present invention.

Referring to a flow chart of FIG. 11, a description will be provided as to an operation of the image forming apparatus of this embodiment. For a better understanding, the description will be provided on the basis of a starting point that is the time when the developer detecting device 30, that is, the developer remainder detecting means 20 detects the change of the developer remainder.

Step 131:

The flat antenna type developer remainder detecting means 20 detects that developer remainder in the developer accommodating container 4 is X% at present.

Step 132:

The discrimination is made as to whether or not the developer remainder=X% is equal to or less than 5% by the processing means 60. If so, the operation goes to YES, and if not it goes to NO.

In the case of NO:

Step 133

If the discrimination at the step 132 is NO, the information relating to the nominal lifetime Y written in the front half 8 bit of the non-volatile memory 31 which is the storing means provided on the process cartridge is read out.

Step 134:

The developer remainder level A% is calculated by the processing means 60, using the following formula (8):

$$A(\%)=X(\%)\times 10000/(Y\times 100) \quad (8)$$

Step 135:

The calculated Level a% of the developer remainder is written in the latter part 8 bit of the non-volatile memory 31 (the storing means provided on the process cartridge).

Step 136:

The developer remainder=A% is displayed on the displaying means 25 or the display of the personal computer.

The operation returns to the step 131 where the above operation is repeated whenever the developer remainder detecting means 20 detects a change of the developer remainder.

In the case of YES:

Step 137:

If the discrimination at the step 132 is NO, the information relating to the nominal lifetime Y written in the front half 8 bit of the non-volatile memory 31 which is the storing means provided on the process cartridge is read out.

Step 138:

The developer remainder level A% is calculated by the processing means 60 using the following formula (9):

$$A(\%)=X(\%)\times 10000/(Y\times 100) \quad (9)$$

Step 139:

The calculated Level a% of the developer remainder is written in the latter part 8 bit of the non-volatile memory 31 (the storing means provided on the process cartridge).

Step 140:

The developer remainder=A% is displayed on the displaying means 25 or the display of the personal computer.

Step 141:

The toner LOW warning is displayed on the displaying means 25 or the display of the personal computer.

The operation returns to the step 131 where the above operation is repeated whenever the developer remainder detecting means 20 detects a change of the developer remainder, so that toner LOW warning is produced always when the developer remainder is not more than 5%.

As described in the foregoing, the amount of the developer in the developer accommodating container 4 detected by the developer remainder detecting means 20 is calculated on the basis of the information relating to the nominal lifetime stored in the storing means 31 carried on the process cartridge as the correct developer remainder level for each of the process cartridges having different nominal lifetimes, and therefore, the warning can be produced at an appropriate timing for each of the process cartridges. The production of the warning is communicated to the user. The calculated developer remainder level is communicated to the user, and is stored in the storing means 31 provided on the process cartridge. Thus, even when the cartridge are exchanged, the developer remainder level can be stored for the cartridge.

The toner LOW warning can be produced at different threshold levels, and in such a case, the above-described method can be used.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge H.

In this embodiment, the use is made of a flat antenna type using electrostatic capacity the developer remainder detecting means 20, but the present invention is not limited to the use thereof, and another developer remainder detecting means is usable, similarly to Embodiment 1. For example, a plate antenna type, which also is an electrostatic capacity detecting type, a torque detecting type or the like, is usable if it can detect the developer remainder.

Embodiment 6

In this embodiment, the amount of the developer filling the developer container is written in storing means 31 provided on the process cartridge B. The description of the portions which are the same as Embodiment 1 or Embodiment 5 is omitted for simplicity.

The developer accommodating container 4 is filled with the developer in such an amount as will meet the nominal lifetime. The nominal lifetime described in Embodiment 5 and the amount of the filled developer described in this embodiment are in one to one relation to each other.

The process cartridge B usable in this embodiment may either be a normal process cartridge B1, which has the nominal lifetime 6000 sheets and which contains 600 g of the developer and a large capacity process cartridge B2, which has the nominal lifetime 10000 sheets and which contains 1000 g of the developer. The process cartridges have the same configuration and are detachably mountable to the same main assembly 100 of the image forming apparatus, except that the amounts of the developer filled in the developer accommodating container 4 are different.

Similarly to the Embodiment 1, the process cartridge B is provided with a developer amount detecting device 30 provided with developer remainder detecting means 20 capable of substantially real-time detection of the remaining amount in accordance with the consumption of developer T in the developer accommodating container 4. There are further provided storing means for storing the information relating to the amount of the developer filled in each of the process cartridges, and storing means for storing the developer remainder level. In this embodiment, similarly to Embodiment 1 and Embodiment 5, the same storing means 31 is used for storing them.

Similarly to Embodiment 1 and Embodiment 5, the image forming apparatus is provided with a means for calculating the developer remainder level on the basis of the result of the detection of the developer remainder detecting means 20 and the information relating to the amount of the developer filled in the process cartridge stored in the storing means 31, means for discriminating whether to produce the toner LOW warning on the basis of the amount of the developer detected by the detecting means, and means for displaying the calculated developer remainder level.

In the front half 8 bit area of the non-volatile memory 31, the weight of the field developer is written.

In this embodiment, the weight of the filled developer is expressed in the unit of 10 g, and the weight of the developer can be set with a unit of 50 g. Therefore, the capacity of the front half 8 bit of the non-volatile memory 31 is enough to store a multiple of 5 from 0–1000, that is, the nominal lifetime from 50 g to 10000 g can be stored with increment of 50 g. In order to store a larger weight of the developer or with a small increment of the weight, the capacity of the non-volatile memory may be increased.

A description will be provided as to the calculating method of the developer remainder level in this embodiment.

Similarly to Embodiment 1, in the process cartridge according to this embodiment and the flat antenna type developer amount detecting means 20, the developer remainder in the developer accommodating container 4 is detected in a percentage on the basis of the maximum detectable range of the amount of the developer being 100%, and with the maximum developer remainder, image formation is capable of printing 10000 sheets from 5% print ratio originals, and the weight of the developer is 1000 g.

In the process cartridge having the information Z relating to the weight of the developer stored in the storing means 31, when the detection output is X(%) of the developer amount detecting means 20, the developer remainder level A in the process cartridge is calculated by the following formula (10):

$$A(\%)=X(\%)\times 1000/(Z\times 10) \quad (10)$$

In formula (3), "1000" is the weight of the developer corresponding to the 100% amount (1000 g in weight) of the developer corresponding to maximum of the detectable range and which has been determined depending on the configuration or the like of the flat antenna type developer amount detecting means 20.

For the normal process cartridge B1 having the nominal lifetime of 6000 sheets and containing the full weight of 600 g of the developer and for the large capacity process cartridge B2 having the nominal lifetime of 10000 sheets and containing the full weight of 1000 g of the developer, the toner LOW warning levels are calculated using the following formula (10):

For normal process cartridge B1:

$$8\%=5\%\times 1000/(60\times 10):$$

For large capacity process cartridge B2:

$$5\%=5(\%)\times 1000/(100\times 10)$$

At these developer remainder levels, the warning is produced.

Thus, even when process cartridges having different nominal lifetimes are used in the same image forming apparatus, the toner LOW warning notifying the user of the shortage of the developer remainder, that is, a prompt of the exchange of the process cartridge, can be produced at the same timing, that is, the time given to the user until the exchange is the same.

The calculated developer remainder level is written in the storing means 31 carried on the process cartridge by way of the controller 61. Simultaneously, it is communicated to the user in the displaying means 25 connected to the controller 61. Alternatively, the signal relating to the level of the developer remainder thus calculated may be transmitted to a personal computer communicable with the image forming apparatus and may be displayed on a display of a personal computer.

The same is applied to the toner LOW warning, and it is communicated to the user on the display portion 15 connected to the controller 61. Alternatively, it may be outputted to a personal computer connected with the image forming apparatus and is displayed on the display of the computer.

As described in the foregoing, the amount of the developer in the developer accommodating container 4 detected by the developer remainder detecting means 20 is calculated on the basis of the information relating to the nominal lifetime stored in the storing means 31 carried on the process cartridge as the correct developer remainder level for each of the process cartridges having different nominal lifetimes, and therefore, the warning can be produced at an appropriate timing for each of the process cartridges. The production of the warning is communicated to the user. The calculated developer remainder level is communicated to the user, and is stored in the storing means 31 provided on the process cartridge. Thus, even when the cartridges are exchanged, the developer remainder level can be stored for the cartridge.

The toner LOW warning can be produced at different threshold levels, and in such a case, the above-described method can be used.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made with a flat antenna type using electrostatic-capacity detection for the developer remainder detecting means 20, but the present invention is not limited to the use thereof, and another developer remainder detecting means is usable, similarly to Embodiment 1.

Embodiment 7

In this embodiment, the developer remainder at which the toner LOW warning should be produced is written in the storing means 31 provided on the process cartridge B. The description of the same portions as with Embodiment 5 is omitted for simplicity.

The process cartridge B of the embodiment, similarly to the description in Embodiment 5, may either be a normal process cartridge B1 having a nominal lifetime 6000 sheets and a large capacity process cartridge B2 having a nominal lifetime 10000 sheets. Such process cartridges have the same configuration and are detachably mountable to the same main assembly 100 of the image forming apparatus, except that amounts of the developer filled in the developer accommodating container 4 are different.

The process cartridges B1, B2 are provided with a developer amount detecting device 30 provided with developer remainder detecting means 20 for substantially real-time detection of the remaining amount in accordance with the consumption of the developer T in the developer accommodating container 4.

There are further provided storing means for storing the information relating to the lifetime of individual process cartridge, storing means for storing the result of detection of the developer remainder detecting means, and storing means for storing the developer remainder level at which the toner LOW warning should be produced in the process cartridge. In this embodiment, similarly to Embodiment 1 and Embodiment 5, the same storing means 31 is used for storing them.

The image forming apparatus is provided with processing means 60 for calculating the developer remainder level on the basis of the result of detection by the developer remainder detecting means 20 and the information relating to the nominal lifetime of the process cartridge stored in the storing means 31, means for discriminating as to whether or not the toner LOW warning should be produced at the calculated developer remainder level, and means for displaying the calculated developer remainder level. In this embodiment, the processing means comprises the means for discriminating whether to produce the toner LOW warning and the means for calculating the developer remainder level.

Similarly to Embodiment 5, in order to discriminate process cartridges having different nominal lifetime and to display the correct developer remainder level, when the detection output of the developer amount detecting means 20 is X(%) in a process cartridge having the information relating to the nominal lifetime Y store in the storing means 31, the developer remainder level A% of the process cartridge is calculated as follows:

$$A(\%)=X(\%)\times 10000/(Y\times 100) \tag{11}$$

In formula (6), "10000" is the number of sheets (nominal lifetime) on which images can be formed from the 5% print ratio originals with the amount 100% of the developer corresponding to maximum detectable range and which has been determined depending on the configuration or the like of the flat antenna type developer amount detecting means 20.

In this embodiment, the memory capacity of the storing means 31 described in Embodiment 5, is increased to store the developer remainder level at which the toner LOW warning should be produced in individual process cartridge.

In the non-volatile memory 31 which is the storing means, the developer remainder level WW% (the value WW) at which the toner LOW warning should be produced in individual process cartridge is written in. The capacity of 8 bit is enough to express an integer in the range of 0–100.

The developer remainder level at which the toner LOW warning should be produced can be calculated before hand using formula (11), for the normal process cartridge B1 having the nominal lifetime of 6000 sheets and for the large capacity process cartridge B2 having the nominal lifetime of 10000 sheets in this embodiment, as follows:

For normal process cartridge B1:

$$8\%=5\%\times 10000/(6\times 100):$$

For large capacity process cartridge B2:

$$5\%=5(\%)\times 10000/(10\times 100)$$

Thus, the developer remainder level 8% at which the toner LOW warning should be produced is stored beforehand in the storing means 31 provided on the normal process cartridge B1 having the nominal lifetime of 6000 sheets, and the developer remainder level 5% at which the toner LOW warning should be produced is stored beforehand in the storing means 31 carried on the large capacity process cartridge B2 having the nominal lifetime of 10000 sheets.

Figure 12:
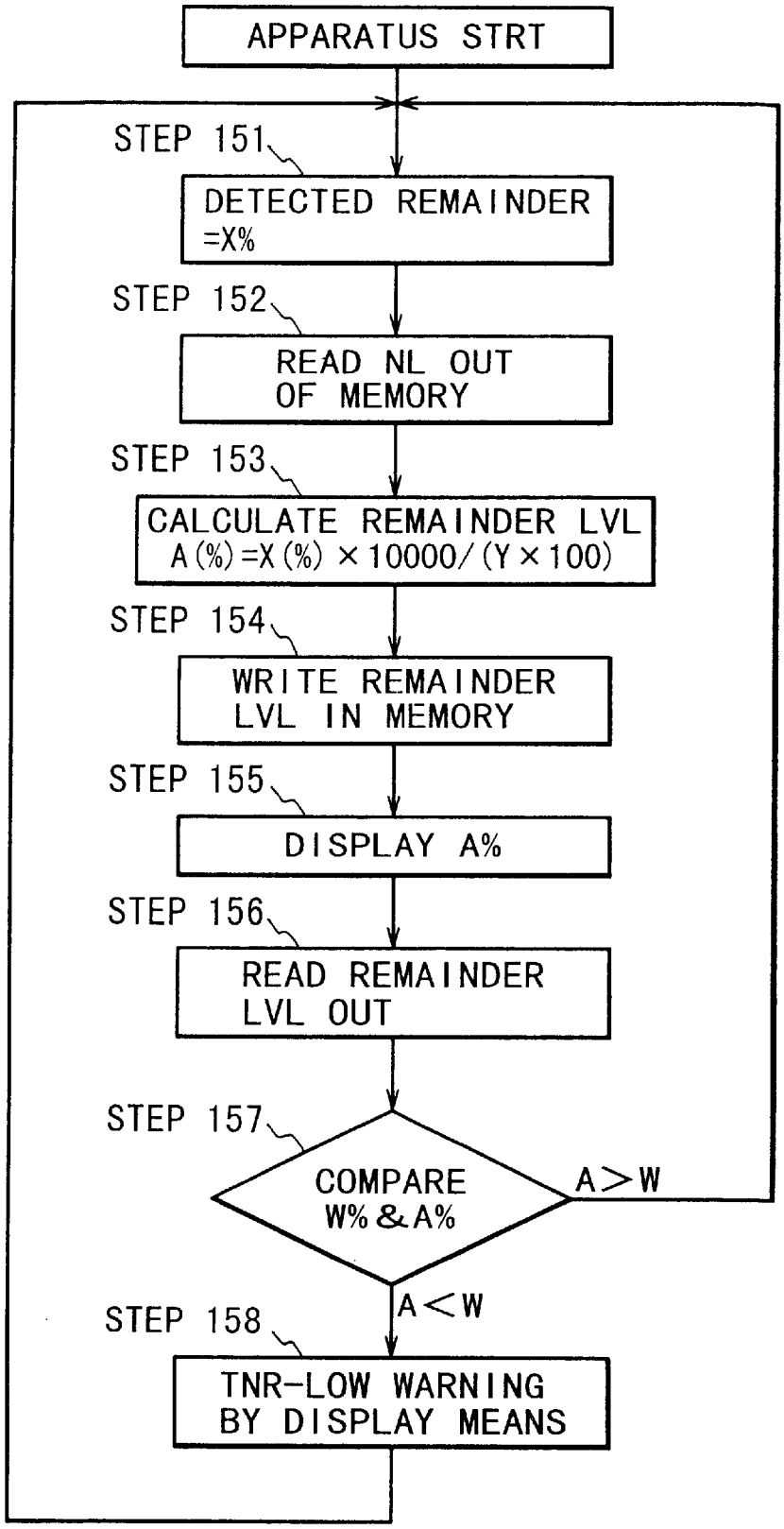
FIG. 12 is a flow chart illustrating an operation for displaying a developer remainder level according to a further embodiment of the present invention.

Referring to a flow chart of FIG. 12, a description will be provided as to the operation of the image forming apparatus according to this embodiment.

For the better understanding, a description will be provided on the basis of the starting point which is the time when the developer detecting device 30, that is, the developer remainder detecting means 20 detects the change of the developer remainder.

Step 151:

The flat antenna type developer remainder detecting means 20 detects that developer remainder in the developer accommodating container 4 is X% at present.

Step 152:

The information relating to the nominal lifetime Y written in the storing means, that is, the non-volatile memory 31 provided on the process cartridge is read out.

Step 153:

The developer remainder level A% is calculated by the processing means 60 using the following formula (12):

$$A(\%)=X(\%)\times 10000/(Y\times 100) \tag{12}$$

Step 154:

The calculated developer remainder level A% is written in the non-volatile memory 31 which is the storing means provided on the process cartridge.

Step 155:

The developer remainder=A% is displayed on the displaying means 25 or the display of the personal computer.

Step 156:

The developer remainder level W at which the toner LOW warning should be produced, written in the non-volatile memory 31 which is the storing means provided on the process cartridge.

Step 157:

The developer remainder level A% calculated by the processing means 60 is compared with the developer remainder level W% at which the toner LOW warning is to be produced and which is stored in the storing means 31.

In the case of A>W:

The operation returns to step 151, and when the developer remainder detecting means 20 detects the change of the developer remainder, the above-described operations are repeated.

A<W:

Step 158:

The toner LOW warning is displayed on the displaying means 25 or the display of the personal computer.

The operation returns to the step 151 where the above-described operations are repeated whenever the developer remainder detecting means 20 detects the change of the developer remainder amount, so that in the toner LOW warning is always produced when the developer remainder level is equal to or lower than the developer remainder level W% at which the toner LOW warning should be produced.

Thus, even when the process cartridges having different nominal lifetimes are used in the same image forming apparatus, the toner LOW warning notifying the user of the shortage of the developer remainder, that is, prompt of the exchange of the process cartridge, can be produced at the same timing, that is, the time given to the user until the exchange is the same.

Thus, the developer remainder level at which the toner LOW warning should be produced is stored in each of the storing means 31 beforehand, and the comparison is made between the stored developer remainder level and the developer remainder level calculated on the basis of the detection output of the developer remainder detecting means 20 and the information relating to the nominal lifetime store in the storing means 31, and on the basis of the comparison, the warning can be produced at an appropriate timing in each of the cartridges. The production of the warning is communicated to the user. The developer remainder level calculation in this manner is communicated to the user and is stored in the storing means 31 carried on the process cartridge. Thus, even when the cartridge are exchanged, the developer remainder level can be stored for the cartridge.

Alternatively, the detection output, the developer remainder detecting means 20 corresponding to the developer amount at which the toner LOW warning should be produced may be stored in the storing means 31. Similarly to Embodiment 5, the toner LOW warning is produced at 5% of the maximum (100%) amount of the developer of the detectable range of the developer remainder detecting means 20. The value "5%" is stored in the storing means 31. The same advantageous effects are provided by comparing the detection output of the developer remainder detecting means 20 at which the toner LOW warning should be produced and which is stored in the storing means 31 with the detection output of the developer remainder detecting means 20.

The toner LOW warning can be produced at different threshold levels, and in such a case, the above-described method can be used.

The processing means 60, namely, the signal processing means for determining the developer remainder through the statistic process of the output signal of the developer remainder detecting means 20, is disposed in the main assembly 100 of the image forming apparatus in this embodiment, and it may be provided in the process cartridge B.

In this embodiment, the use is made of a flat antenna type using the electrostatic capacity dejection is used for the developer remainder detecting means 20, but the present invention is not limited to the use thereof, and another developer remainder detecting means is usable, similarly to Embodiment 1.

Embodiment 8

Figure 13:
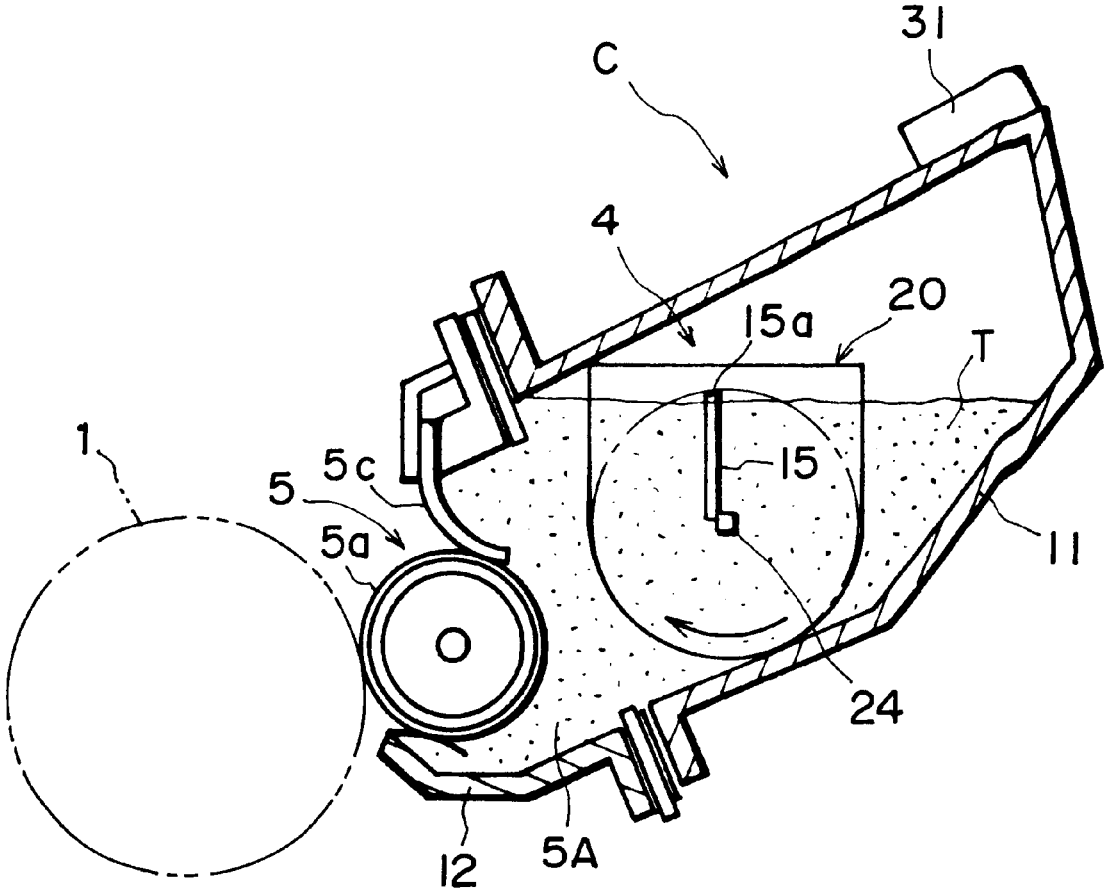
FIG. 13 is a sectional view of a developing device in the form of a cartridge according to an embodiment of the present invention.

FIG. 13 shows a developing device C according to an embodiment of the present invention, the developing device C being in the form of a cartridge.

The developing device C of this embodiment comprises a developer carrying member such as a developing roller 5*a*, and a developer chamber 5A accommodating a developer to be supplied to the developer carrying member, and they are formed into a cartridge by the developing device frames 11, 12 of plastic resin material. The developing device C of this embodiment corresponds to a developing device structure portion of the process cartridge B of Embodiment 1, which is formed into a unit, and in other words, it corresponds to the process cartridge B from which the photosensitive drum 1, charging means 2 and the cleaning means 7 are omitted. The developing unit C may be provided with a memory used in embodiments 1–7, and/or the remaining amount display level calculation method used in embodiments 1–7 and remaining toner amount LOW warning timing setting method may be used.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

a developer container for containing a developer;

developer amount detecting means for detecting an amount of the developer contained in said developer container;

a memory; and calculating means for calculating a display level of a remaining amount of the developer, wherein at least said developer container and said memory are in a unit which is detachably mountable to a main assembly of said image forming apparatus, wherein said memory stores information relating to a nominal lifetime of said unit, and wherein said calculating means calculates the display level in accordance with an amount detected by the developer amount detecting means and the information relating to the nominal lifetime.

2. An image forming apparatus according to claim 1, further comprising warning means for warning of a shortage of the developer.

3. An image forming apparatus according to claim 2, wherein said warning means produces a warning when the display level calculated by said calculating means is lower than a predetermined level.

4. An image forming apparatus according to claim 2, wherein said warning means produces a warning when the amount detected by said developer amount detecting means is smaller than a predetermined level.

5. An image forming apparatus according to claim 1, further comprising a display means for displaying the display level calculated by said calculating means.

6. An image forming apparatus according to claim 1, further comprising outputting means for outputting the display level calculated by said calculating means to an external device, which displays the display level.

7. An image forming apparatus according to claim 1, wherein the information relating to the nominal lifetime relates to an initial amount of the developer contained in the developer container.

8. An image forming apparatus according to claim 1, wherein the nominal lifetime information relates to a number of prints which can be produced by said unit prior to initial use.

9. An image forming apparatus according to claim 1, wherein said unit further comprises at least one of said developer amount detecting means and said calculating means.

10. An image forming apparatus according to claim 1, wherein said unit further comprises at least one of an image bearing member, developing means for supplying the developer to said image bearing member, and cleaning means for cleaning said image bearing member.

11. An image forming apparatus comprising:

a unit detachably mountable to a main assembly of said image forming apparatus, said unit having memory and a developer container for containing a developer; and calculating means for calculating a display level of a remaining amount of the developer;

wherein said memory stores information relating to a nominal lifetime of said unit, and said calculating means calculates the display level in accordance with the remaining amount of the developer in said developer container and the information relating to the nominal lifetime.

12. An image forming apparatus according to claim 11, further comprising a developer amount detecting means for detecting an amount of the developer contained in said developer container, wherein said calculating means calculates the display level in accordance with the amount detected by said developer amount detecting means and the information relating to the nominal lifetime.

13. An image forming apparatus according to claim 11, further comprising a display means for displaying the display level calculated by said calculating means.

14. An image forming apparatus according to claim 11, wherein the information relating to the nominal lifetime relates to information of an initial amount of the developer contained in the developer container.

15. An image forming apparatus according to claim 11, wherein the information of the nominal lifetime relates to a number of prints which can be produced by said unit prior to initial use.

16. A unit detachably mountable to an image forming apparatus, comprising:

a memory; and a developer container for containing a developer;

wherein said memory stores information relating to a nominal lifetime of said unit and information of a remaining amount of a developer detected by a remaining amount detecting means.

17. A unit according to claim 16, wherein the information relating to the nominal lifetime relates to an initial amount of the developer contained in said developer container.

18. A unit according to claim 16, wherein the information of the nominal lifetime relates to a number of prints which can be produced by said unit prior to initial use.

19. A unit according to claim 16, wherein said memory stores a display level of a developer remainder calculated in accordance with information of a remaining amount of a developer detected by said remaining amount detecting means and information relating to the nominal lifetime stored in said memory.

20. A unit according to claim 16, wherein said memory further stores a predetermined remaining amount display level.

21. A unit according to claim 20, wherein said memory stores a remaining amount display level calculated in accordance with information of a remaining amount of the developer detected by said remaining amount detecting means and information relating to the nominal lifetime stored in said memory, and wherein the calculated remaining amount display level and the predetermined remaining amount display level are stored in different memory areas.

22. A unit according to claim 16, wherein said memory further stores predetermined developer remaining information.

23. A unit according to claim 22, wherein said memory further stores developer remaining amount information detected by the remaining amount detecting means, and wherein the detected remaining amount information and the predetermined remaining amount information are stored in different memory areas.

24. A unit according to claim 16, wherein said unit further comprises calculating means for calculating a remaining amount display level of the developer in said container in accordance with the detected remaining amount of the developer in said developer container and information relating to the nominal lifetime.

25. A unit according to claim 16, further comprising the remaining amount detecting means for detecting a remaining amount of the developer in said developer container.

26. A unit according to claim 16, wherein said unit further comprises a controller for controlling information writing in said memory and information read from said memory.

27. A unit according to claim 16, further comprising at least one of an image bearing member, developing means for supplying the developer to said image bearing member and cleaning means for cleaning said image bearing member.

28. A displaying method for displaying a developer remainder in unit detachably mountable to an image forming apparatus, comprising:

a step of detecting a remaining amount of the developer in said unit;

a step of calculating a developer remainder display level in accordance with a detected developer remaining amount and information relating to a nominal lifetime of said unit; and a step of displaying the thus calculated developer remainder display level on a display.

29. A method according to claim 28, wherein the information relating to the nominal lifetime relates to a number of prints which can be produced by said unit prior to initial use.

30. A method according to claim 28, wherein the information relating to the nominal lifetime relates to an initial amount of the developer contained in said unit.

31. A developer remainder displaying system comprising:

a first unit which is detachably mountable to a main assembly of an image forming apparatus, wherein a developer is contained in said first unit;

a second unit which is detachably mountable to the main assembly of said image forming apparatus, wherein an initial amount of the developer contained in said second unit is larger than an initial amount of the developer contained in said first unit, and wherein said second unit can be mounted to the main assembly of said image forming apparatus in place of said first unit; and a display for displaying a remaining amount display level of the developer;

wherein an amount of decrease of the remaining amount display level on the display per unit consumption of the developer when said second unit is mounted, is smaller than that when said first unit is mounted.

32. A system according to claims 31, wherein said system is capable of producing warnings of a shortage of the developer on said display, and the remaining amount display level, when the warning is produced with the second unit mounted to the main assembly, is lower than that when said first unit is mounted to the main assembly.

33. A developer remainder displaying system comprising:

a first unit which is detachably mountable to a main assembly of an image forming apparatus, wherein a developer is contained in said first unit;

a second unit which is detachably mountable to the main assembly of said image forming apparatus wherein an initial amount of the developer contained in said second unit is different from an initial amount of the developer contained in said first unit, and wherein said second unit can be mounted to the main assembly of said image forming apparatus in place of said first unit; and a display for displaying a remaining amount display level of the developer;

wherein the remaining amount display level of said first unit when said first unit which is unused is mounted to the main assembly, and the remaining amount display level of said second unit when said second unit which is unused is mounted to the main assembly, are the same.

34. A cut-down type developer containing unit containing an initial first predetermined amount of developer for an electrophotographic image forming apparatus, which amount is less than the capacity thereof, said apparatus including means for displaying a level of a remaining amount of the developer, said unit comprising:

a container containing the initial first predetermined amount of the developer which is less than the capacity of said container; and information means carrying information for permitting said display means to display a remaining amount display level when said unit which is unused and contains the initial first predetermined amount of the developer, is mounted to said image forming apparatus, the remaining amount display level being the same as a remaining amount display level displayed by said display means when a full-type developer containing unit which is unused and contains an information means carrying information for permitting said display means to display a remaining amount display level when said unit which is unused and contains the initial first predetermined amount of the developer, is mounted to said image forming apparatus, the remaining amount display level being the same as a remaining amount display level displayed by said display means when a full-type developer containing unit which is unused and contains an initial second predetermined amount of the developer which is larger than the initial first predetermined amount of the developer, is mounted to said image forming apparatus.

35. A second unit according to claim 34, wherein said information means includes memory information relating to a lifetime of said cut-down type unit.

* * * * *

UNITED STATES PATENT AND TRADEMARK OFFICE

CERTIFICATE OF CORRECTION

PATENT NO. : 6,587,649 B1
DATED : July 1, 2003
INVENTOR(S) : Shinya Yamamoto et al.

It is certified that error appears in the above-identified patent and that said Letters Patent is hereby corrected as shown below:

Column 32,
Line 40, “claims” should read -- claim --.

Signed and Sealed this

Eighteenth Day of November, 2003

JAMES E. ROGAN
*Director of the United States Patent and Trademark Office*